US011351538B2

(12) United States Patent
Hosic et al.

(10) Patent No.: US 11,351,538 B2
(45) Date of Patent: Jun. 7, 2022

(54) FLUIDIC DEVICE AND METHOD OF ASSEMBLING SAME

(71) Applicant: Northeastern University, Boston, MA (US)

(72) Inventors: Sanjin Hosic, Malden, MA (US); Ryan A. Koppes, Charlestown, MA (US); Shashi K. Murthy, Newton, MA (US); Abigail N. Koppes, Charlestown, MA (US); Jonathan R. Soucy, Boston, MA (US)

(73) Assignee: NORTHEASTERN UNIVERSITY, Boston, MA (US)

( * ) Notice: Subject to any disclaimer, the term of this patent is extended or adjusted under 35 U.S.C. 154(b) by 515 days.

(21) Appl. No.: 16/120,198

(22) Filed: Aug. 31, 2018

(65) Prior Publication Data

US 2019/0083979 A1 Mar. 21, 2019

Related U.S. Application Data

(60) Provisional application No. 62/677,655, filed on May 29, 2018, provisional application No. 62/560,350, filed on Sep. 19, 2017.

(51) Int. Cl.
*B01L 3/00* (2006.01)

(52) U.S. Cl.
CPC ... *B01L 3/502707* (2013.01); *B01L 3/502715* (2013.01); *B01L 2200/027* (2013.01);
(Continued)

(58) Field of Classification Search
CPC ..... B01L 3/502707; B01L 3/502715; B01L 2200/12; B01L 2200/0689;
(Continued)

(56) References Cited

U.S. PATENT DOCUMENTS 10,988,723 B1 * 4/2021 Hatch ..... C12M 23/44
2002/0023684 A1 * 2/2002 Chow ..... B01L 3/502707 137/833

(Continued)

OTHER PUBLICATIONS

Li, Z. & Cui, Z. Three-dimensional perfused cell culture. Biotechnol Adv 32, 243-254 (2014).

(Continued)

*Primary Examiner* — Samuel P Siefke
(74) *Attorney, Agent, or Firm* — Hamilton, Brook, Smith & Reynolds, P.C.

(57) ABSTRACT

An embodiment is a scientific fluidic device and a method of assembly of single and multilayer fluidic devices via laser cut and assembly of double sided adhesives. The device includes a member defining a cavity and having two sides, both sides including an adhesive compound, and at least one substrate defining at least two plenums and coupling to the member, forming a flow path. The components of the fluidic device are produced via laser cut and assembly methods. The fluidic device remains intact via adhesive coupling between the substrate(s), member(s), and membrane(s). Altogether, the fluidic device requires assembly that is efficient and economical, resulting in high throughput manufacturing of the fluidic devices.

18 Claims, 16 Drawing Sheets
(7 of 16 Drawing Sheet(s) Filed in Color)

(52) U.S. Cl.
CPC ..... *B01L 2200/028* (2013.01); *B01L 2200/0689* (2013.01); *B01L 2200/12* (2013.01); *B01L 2300/0627* (2013.01); *B01L 2300/0819* (2013.01); *B01L 2300/0861* (2013.01); *B01L 2300/0874* (2013.01); *B01L 2300/0887* (2013.01); *B01L 2300/12* (2013.01)

(58) Field of Classification Search
CPC ..... B01L 2300/0887; B01L 2200/028; B01L 2300/0874; B01L 2200/027; B01L 2300/12; B01L 2300/0819; B01L 2300/0861; B01L 2300/0627
See application file for complete search history.

(56) References Cited

U.S. PATENT DOCUMENTS

2002/0059869 A1* 5/2002 Martin ..... F25B 9/00 96/4
2002/0187074 A1* 12/2002 O'Connor ..... B82Y 30/00 422/82.05

OTHER PUBLICATIONS

Maggiorani, D. et al. Shear Stress-Induced Alteration of Epithelial Organization in Human Renal Tubular Cells. PLoS One 10 (2015).
Gayer, C. P. & Basson, M. D. Tire effects of mechanical forces on intestinal physiology and pathology. Cellular signalling 21, 1237-1244 (2009).
Powell, D. W. et al. Myofibroblasts. II. Intestinal subepithelial myofibroblasts. Am J Physiol 277, C183-201 (1999).
Yoo, B. B. & Mazmanian, S. K. The Enteric Network: Interactions between the Immune and Nervous Systems of the Gut. Immunity 46, 910-926 (2017).
Huh, D., Hamilton, G. A. & higher, D. E. From 3D cell culture to organs-on-chips. Trends Cell Biol 21, 745-754 (2011).
Esch, E. W., Bahinski, A. & Huh, D. Organs-on-chips at the frontiers of drug discovery. Nature reviews. Drug discovery 14, 248-260 (2015).
Huh, D. et al. Microfabrication of human organs-on-chips. Nat Protoc 8, 2135-2157 (2013).
Huh, D. et al. Reconstituting organ-level lung functions on a chip. Science 328, 1662-1668 (2010).
Kim, H. J. & Ingber, D. E. Gut-on-a-Chip microenvironment induces human intestinal cells to undergo villus differentiation. Integr Biol (Camb) 5, 1130-1140 (2013).
Kim, H. J., Li, H., Collins. J. J. & Ingber, D. E. Contributions of microbiome and mechanical deformation to intestinal bacterial overgrowth and inflammation in a human gut-on-a-chip. Proc Natl Acad Sci U S A 113, E7-15 (2016).
Kasendra, M. et al. Development of a primary human Small Intestine-on-a-Chip using biopsy-derived organoids. Sci Rep 8, 2871 (2018).
Lee, J. S. et al. Placenta-on-a-chip: a novel platform to study the biology of the human placenta. J Matern Fetal Neonatal Med 29, 1046-1054 (2016).
Shah, P. et al. A microfluidics-based in vitro model of the gastro-intestinal human-microbe interface. Nat Commun 7, 11535 (2016).
Torisawa, Y. S. et al. Bone marrow-on-a-chip replicates hematopoietic niche physiology in vitro. Nat Methods 11, 663-669 (2014).
Sellgren, K. L., Hawkins, B. T. & Grego, S. An optically transparent membrane supports shear stress studies in a three-dimensional microfluidic neurovascular unit model. Biomicrofluidics 9, 061102 (2015).
Jeon, J. S. et al. Human 3D vascularized organotypic microfluidic assays to study breast cancer cell extravasation. Proc Natl Acad Sci U S A 112, 214-219 (2015).
Adriani, G., Ma, D., Pavesi, A., Kamm, R. D. & Goh, E. L. K. A 3D neurovascular microfluidic model consisting of neurons, astrocytes and cerebral endothelial cells as a blood-brain barrier. Lab on a Chip 17, 448-459 (2017).
Esch, M. B., King, T. L. & Shuler, M. L. The role of body-on-a-chip devices in drug and toxicity studies. Annu Rev Biomed Eng 13, 55-72 (2011).
Edington, C. D. et al. Interconnected Microphysiological Systems for Quantitative Biology and Pharmacology Studies. Sci Rep 8, 4530 (2018).
Imura, Y., Asano, Y., Sato, K. & Yoshimura, E. A microfluidic system to evaluate intestinal absorption. Anal Sci 25, 1403-1407 (2009).
Kim, H. J., Huh, D., Hamilton, G. & Ingber, D. E. Human gut-on-a-chip inhabited by microbial flora that experiences intestinal peristalsis-like motions and flow. Lab on a Chip 12, 2165-2174 (2012).
Jang, K. J. & Suh, K. Y. A multi-layer microfluidic device for efficient culture and analysis of renal tubular cells. Lab Chip 10, 36-42 (2010).
Halldorsson, S., Lucumi, E., Gomez-Sjoberg, R. & Fleming. R. M. Advantages and challenges of microfluidic cell culture in polydimethylsiloxane devices. Biosens Bioelectron 63, 218-231 (2015).
Zheng, L., Kelly, C. J. & Colgan, S. P. Physiologic hypoxia and oxygen homeostasis in the healthy intestine. A Review in the Theme: Cellular Responses to Hypoxia. Am J Physiol Cell Physiol 309, C350-360 (2015).
Heo, Y. S. et al. Characterization and Resolution of Evaporation-Mediated Osmolality Shifts That Constrain Microfluidic Cell Culture in Poly(dimethylsiloxane) Devices. Analytical Chemistry 79, 1126-1134 (2007).
Aran, K., Sasso, L. A., Kamdar, N. & Zahn. J. D. Irreversible, direct bonding of nanoporous polymer membranes to PDMS or glass microdevices. Lab on a chip 10, 548-552 (2010).
Hubatsch, I., Ragnarsson, E. G. & Artursson, P. Determination of drug permeability and prediction of drug absorption in Caco-2 monolayers. Nat Protoc 2, 2111-2119 (2007).
Artursson, P., Palm, K. & Luthman, K. Caco-2 monolayers in experimental and theoretical predictions of drug transport. Adv Drug Deliv Rev 46, 27-43 (2001).
Hidalgo, I. J., Raub, T. J. & Borchardt, R. T. Characterization of the human colon carcinoma cell line (Caco-2) as a model system for intestinal epithelial permeability. The AAPS Journal, vol. 13, No. 3, Gastroenterology 96, 736-749 (2011).
Kim, H. J., Huh, D., Hamilton, G. & Ingber, D. E. Human gut-on-a-chip inhabited by microbial flora that experiences intestinal peristalsis-like motions and flow. Lab Chip 12, 2165-2174 (2012).
Sato, T. & Clevers, H. Growing Self-Organizing Mini-Guts from a Single Intestinal Stem Cell: Mechanism and Applications. Science 340, 1190-1194 (2013).
Leushacke, M. & Barker, N. Ex vivo culture of the intestinal epithelium: strategies and applications. Gut 63, 1345-1354 (2014).
Clevers, H. Modeling Development and Disease with Organoids. Cell 165, 1586-1597 (2016).
Dekkers, J. F. et al. A functional CFTR assay using primary cystic fibrosis intestinal organoids. Nat Med 19, 939-947 (2013).
Fordham, R. P. et al. Transplantation of expanded fetal intestinal progenitors contributes to colon regeneration after injury. Cell Stem Cell 13, 734-744 (2013).
Noel, G. et al. A primary human macrophage-enteroid co-culture model to investigate mucosal gut physiology and host-pathogen interactions. Sci Rep 7, 45270 (2017).
In, J. et al. Enterohemorrhagic *Escherichia coli* Reduces Mucus and Intermicrovillar Bridges in Human Stem Cell-Derived Colonoids. Cellular and Molecular Gastroenterology and Hepatology 2, pp. 1-14 (2016).
VanDussen, K. L. et al. Development of an enhanced human gastrointestinal epithelial culture system to facilitate patient-based assays. Gut 64, 911-920 (2015).

(56) References Cited

OTHER PUBLICATIONS

Sato, T. et al. Single Lgr5 stem cells build crypt-villus structures in vitro without a mesenchymal niche. Nature 459, 262-265, doi:http://www.nature.com/nature/journal/v459/n7244/suppinfo/nature07935_S1.html (2009).
Miyoshi, H. & Stappenbeck, T. S. In vitro expansion and genetic modification of gastrointestinal stem cells as organoids. Nature protocols 8, 2471-2482 (2013).
Hubatsch, I., Ragnarsson, E. G. E. & Artursson, P. Determination of drug permeability and prediction of drug absorption in Caco-2 monolayers. Nat. Protocols 2, 2111-2119 (2007).
Sackmann, E. K., Fulton, A. L. & Beebe, D. J. The present and future role of microfluidics in biomedical research. Nature 507, 181-189 (2014).
Temiz, Y., Lovchik, R. D., Kaigala, G. V. & Delamarche, E. Lab-on-a-chip devices: How to close and plug the lab? Microelectronic Engineering 132, 156-175, https://doi.org/10.1016/j.mee.2014.10.013 (2015).
Yang, W. H., Smolen, V. F. & Peppas, N. A. Oxygen Permeability Coefficients of Polymers for Hard and Soft Contact-Lens Applications. J Membrane Sci 9, 53-67 (1981).
Phan, D. T. T. et al. A vascularized and perfused organ-on-a-chip platform for large-scale drug screening applications. Lab on a Chip 17, 511-520 (2017).
Stenberg, P., Norinder, U., Luthman, K. & Artursson, P. Experimental and computational screening models for the prediction of intestinal drug absorption. J Med Chem 44, 1927-1937 (2001).
Nath, P. et al. Polymerase chain reaction compatibility of adhesive transfer tape based microfluidic platforms. Microsystem Technologies 20, 1187-1193 (2014).
Sant, H. J. & Gale, B. K. Flexible fabrication, packaging, and detection approach for microscale chromatography systems. Sensors and Actuators B: Chemical 141, 316-321 (2009).
Crews, N., Wittwer, C. & Gale, B. Continuous-flow thermal gradient PCR. Biomed Microdevices 10, 187-195 (2008).
Kim, J., Surapaneni, R. & Gale, B. K. Rapid prototyping of microfluidic systems using a PDMS/polymer tape composite. Lab on a Chip 9, 1290-1293 (2009).
Leonard, M., Creed, E., Brayden, D. & Baird, A. W. Evaluation of the Caco-2 monolayer as a model epithelium for iontophoretic transport. Pharm Res 17, 1181-1188 (2000).
Buzza, M. S. et al. Membrane-anchored serine protease matriptase regulates epithelial barrier formation and permeability in the intestine. Proc Natl Acad Sci U S A 107, 4200-4205 (2010).
Cajnko, M. M. et al. Listeriolysin O Affects the Permeability of Caco-2 Monolayer in a Pore-Dependent and Ca2+-Independent Manner. PLoS One 10, e0130471 (2015).
Karlsson, J. & Artursson, P. A Method for the Determination of Cellular Permeability Coefficients and Aqueous Boundary-Layer Thickness in Monolayers of Intestinal Epithelial (Caco-2) Cells Grown in Permeable Filter Chambers. Int J Pharm 71, 55-64 (1991).
Deng, X., Zhang, G., Shen, C., Yin, J. & Meng, Q. Hollow fiber culture accelerates differentiation of Caco-2 cells. Applied Microbiology and Biotechnology 97, 6943-6955 (2013).
Ferruzza, S., Rossi, C., Scarino, M. L. & Sambuy, Y. A protocol for differentiation of human intestinal Caco-2 cells in asymmetric serum-containing medium. Toxicol In Vitro 26, 1252-1255 (2012).
Baltes, S., Nau, H. & Lampen, A. All-trans retinoic acid enhances differentiation and influences permeability of intestinal Caco-2 cells under serum-free conditions. Dev Growth Differ 46, 503-514 (2004).
Jang, K. J. et al. Human kidney proximal tubule-on-a-chip for drug transport and nephrotoxicity assessment. Integr Biol (Camb) 5, 1119-1129 (2013).
Pan, F., Han, L., Zhang, Y., Yu. Y. & Liu, J. Optimization of Caco-2 and HT29 co-culture in vitro cell models for permeability studies. Int J Food Sci Nutr 66, 680-685 (2015).
Okumura, R. & Takeda, K. Roles of intestinal epithelial cells in the maintenance of gut homeostasis Exp Mol Med 49, e338 (2017).
Hilgendorf, C. et al. Caco-2 versus Caco-2/HT29-MTX co-cultured cell lines: permeabilities via diffusion, inside- and outside-directed carrier-mediated transport. J Pharm Sci 89, 63-75 (2000).
Schaart, M. W. et al. A novel method to determine small intestinal barrier function in human neonates in vivo. Gut 55, 1366-1367 (2006).
Matsuo, K., Ota, H., Akamatsu, T., Sugiyama, A. & Katsuyama, T. Histochemistry of the surface mucous gel layer of the human colon. Gut 40, 782-789 (1997).
Navabi, N., McGuckin, M. A. & Linden, S. K. Gastrointestinal cell lines form polarized epithelia with an adherent mucus layer when cultured in semi-wet interfaces with mechanical stimulation. PLoS One 8, e68761 (2013).
Sambuy, Y. et al. The Caco-2 cell line as a model of the intestinal barrier: influence of cell and culture-related factors on Caco-2 cell functional characteristics. Cell Biology and Toxicology 21, 1-26 (2005).
Grabinger, T. et al. Ex vivo culture of intestinal crypt organoids as a model system for assessing cell death induction in intestinal epithelial cells and enteropathy. Cell Death & Disease 5, e1228, (2014).
Esch, E. W., Bahinski, A. & Huh, D. Organs-on-chips at the frontiers of drug discovery. Nat Rev Drug Discov 14, 248-260 (2015).

* cited by examiner

Intestinal stem cell expansion in bulk Matrigel 7-10 days →

Organoid dissociation and monolayer seeding → 1-2hr →

Transwell based monolayers → 7 days

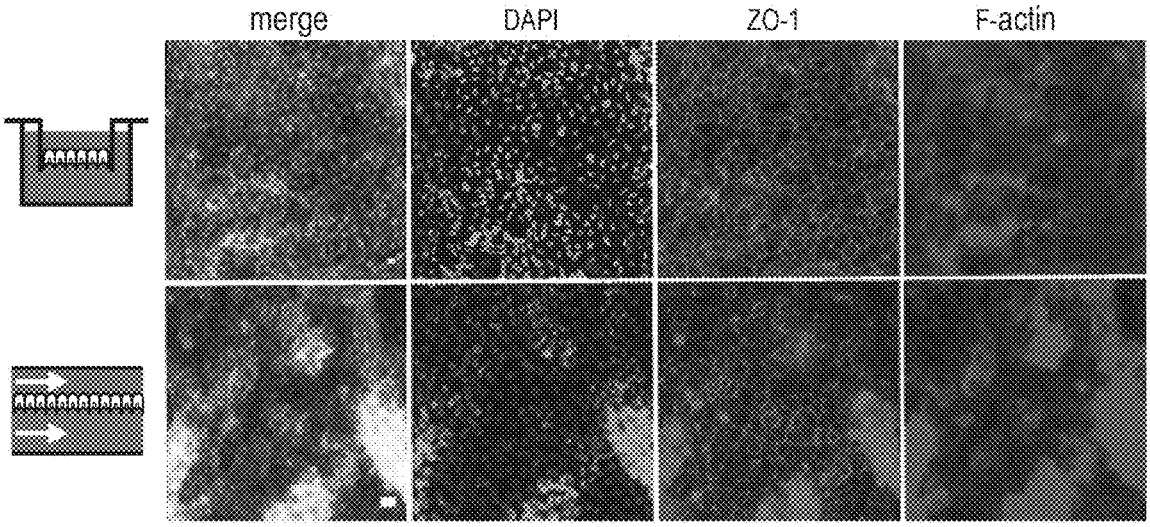
FIG. 12A
FIG. 12B-1
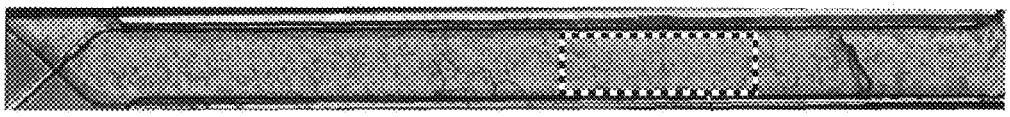
FIG. 12B-2
FIG. 12B-2
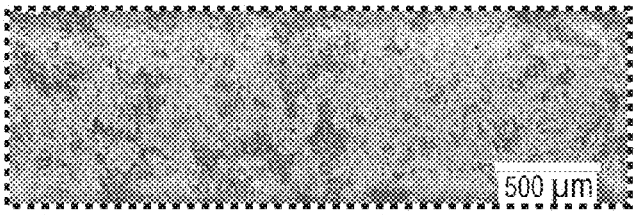
FIG. 12C
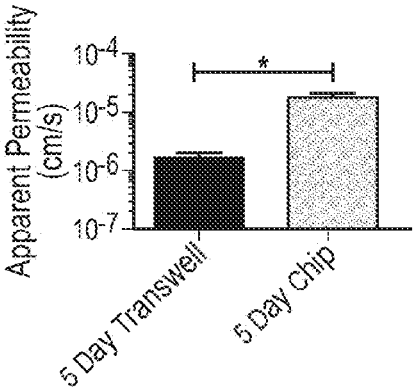

FLUIDIC DEVICE AND METHOD OF ASSEMBLING SAME

RELATED APPLICATION(S)

This application claims the benefit of U.S. Provisional Application No. 62/677,655, filed on May 29, 2018, entitled, "Laser Cut and Assembly of Organs-On-Chips," and U.S. Provisional Application No. 62/560,350, filed on Sep. 19, 2017 entitled, "Rapid, Benchtop, Manufacturing of Microfluidic Organs-On-Chips With Integrated Electrodes Using Laser Cut Double Sided Adhesives, Thermoplastics, And Inkjet Printed Silver Electrodes." The entire teachings of the above applications are incorporated herein by reference.

GOVERNMENT SUPPORT

This invention was made with government support under Grant No.: R21 EB025395 awarded by the National Institutes of Health. The government has certain rights in the invention.

BACKGROUND

Tissue culture is a valuable tool for studying biology and designing therapeutics. In vivo, the circulatory and lymphatic systems maintain a biochemical steady state through a continuous nutrient supply and removal of waste products. Microfluidic devices are used to develop three-dimensional cell culture models that recapitulate heterogeneous tissue-tissue interfaces while continuous media perfusion maintains biochemical homeostasis and flow induced shear stress.

SUMMARY

Organs-on-chips hold potential as a technology to supplement drug screening and development practices in order to accelerate the drug-screening process, improve reproducibility, and alleviate expenditures. Facile, rapid, economic, and reliable device fabrication would promote interdisciplinary adoption and technological development. Fluidic devices used for developing cell culture models are most frequently fabricated via poly(dimethylsiloxane) (PDMS) soft lithography. The advantages of PDMS organs-on-chips include high feature resolution, biocompatibility, optical transparency, and gas permeability enabling culture oxygenation and pH control in standard $CO_2$ incubators. PDMS organs-on-chips, however, have several drawbacks. PDMS's gas permeability prohibits $O_2$ tension control for recapitulating hypoxic tissues such as the small intestine. PDMS's water vapor permeability results in evaporation induced bubble formation or high osmolarity, which can block flow and impact cell fate and viability. PDMS absorbs hydrophobic molecules, complicating drug pharmacokinetic studies. While PDMS easily bonds to both itself and glass via plasma activation, bonding to polymers requires additional processing, such as silanization.

PDMS soft lithography requires significant microfabrication training and capital infrastructure. Moreover, initial prototyping may require multiple iterations, and lithographic mold fabrication can be prohibitively expensive (currently \$150-\$500 per design from $3^{rd}$ party manufacturers). Other investigators have 3D printed microfluidic cell culture models, but these single channel devices do not integrate membranes for recapitulating tissue-tissue interfaces.

Embodiments of the present invention significantly facilitate the commercial development of organ-on-chip platforms by accelerating fabrication and enabling researchers to manufacture models more easily in comparison to microfabrication techniques. Embodiments no longer require researchers have access to microfabrication training and/or facilities.

Example embodiments of the present invention provide a fluidic device, a method for forming the fluidic device, and a kit that includes components used in forming the fluidic device. Embodiments of the present method used in producing the fluidic device eliminate problems encountered in the art and cost significantly less than producing other technologies of the art.

Embodiments of the present invention generally relate to the field of fluidic devices and, more particularly, to integration of a double-sided adhesive, coupled with at least one substrate, in defining a cavity, at least part of which forms at least a portion of a flow path through which fluids may pass. Embodiments may be used, for example, in the development of organic tissue. A method of forming and assembling the fluidic device is also contemplated within the scope of the invention.

An embodiment of the present invention is directed to the fabrication of a multi-layered integrated, fluidic device, with membrane for organic tissue development that can be used to integrate membranes for recapitulating tissue-tissue interfaces. Such a device includes at least a first and a second substrate, a member with opposing adhesive sides used in coupling the substrates, plenums traversing the substrates to provide fluidic coupling from a location external from the first or second substrate to either the first or second side of the member, and a cavity defined by the member that forms at least a portion of a flow path in combination with the first or second substrates.

In an embodiment, the fluidic device includes a first and second substrate coupled to a member, with a first side and a second side, that defines a cavity. In this embodiment, the first and second sides of the member includes (e.g., are coated with) an adhesive compound and define respective openings of a cavity. When coupled with the substrates, the combination of the member and substrates defines a cavity through which a fluid can flow.

In another embodiment, the cavity, as defined by the member coupled to the first and second substrates, traverses a length of the fluidic device defined by the member and the substrate, creating an end-to-end path through which fluids may flow. Fluid may be introduced through a first opening in-between the two substrates at one side of the fluidic device and flows through the cavity and exits at a second opening on the side opposing the first opening or at a different side. In this embodiment, the first and second openings are configured to receive and secure vessels capable of delivering and receiving fluid entering and exiting the device.

In another embodiment, the cavity is defined between two plenums within the member, the plenums traversing the substrates and defined to be in fluidic communication with the cavity also defined by the member. In this embodiment, fluid may enter the device through the plenums and then enter the cavity through a point of fluidic communication between the plenums and the member defining the cavities. The plenums may be configured (e.g., sized and positioned) to serve as an adaptor for a biological or other type of sensor. In the case of a biological sensor, the sensor may be configured to detect a range of sample characteristics that may impact proliferation of organic tissue.

In another embodiment, a substrate is adhesively coupled to one side of a member, the member defining a cavity on one side of the member. A plenum may be defined by the substrate at a location that, in a coupled state with the membrane, has the plenum traverse the device and in fluidic communication with the cavity of the member. With only one side of the member defining a cavity, being coupled to a first substrate, the device is configured to receive fluid in the cavity while the side not coupled to the substrate is exposed to its environment.

In another embodiment, the fluidic device contains multiple layers with at least one integrated porous membrane. Each layer comprises at least one member with at least one cavity forming a flow path between at least two plenums in fluidic communication with the respective cavity, the plenums defined by at least one substrate and fluidically coupled to at least a subset of cavities within the multiple layers. In multilayer devices, each layer may comprise a separate flow path or cavities of some layers may be fluidically coupled to cavities of other layers. In some embodiments, separate flow path layers may be configured to interact with one another through integration of a porous membrane, which is configured to promote physical interaction between the different layers, through, for example, molecular traversal through the membrane.

In another embodiment, the fluidic device contains a member defining a cavity and defining a compartment, which may be a combination of a set of sub-compartments, which, through use of a phase guide, are configured to hold biological samples adjacent to one another and prevent the separate biological samples from interacting with each other. The phase guide in this embodiment is configured to compartmentalize the samples. The embodiment includes substrates that define plenums configured to traverse the device, in an assembled state, along a center line of the device on opposing sides of the device. The plenums enable fluid to pass through the plenums on opposing sides of the device and into the cavity or a compartment. Within the compartment, and depending through which plenum a fluid flows, the fluid may flow into a subcompartment. During usage, the device or compartment composing the device may enable an environmental stimulus to trigger a biological reaction between (i) a sample in the cavity, compartment, or subcompartment and (ii) a fluid, or to self-react in response to the environmental stimulus. Examples of environmental stimuli include temperature, irradiance from a light source, electromagnetic energy, small molecules, pharmaceuticals, metabolites, and biological compounds.

Alternatively, the biological sample may be deposited in the device, then a fluid such as a gas or liquid, may be subsequently flowed into the cavity, compartment, or subcompartment to trigger the reaction with or without additional environmental stimuli.

A method for assembling an embodiment of the present invention may comprise a rapid cut and assemble manufacturing process that includes a laser cutter/engraver, a member with an adhesive compound on opposing sides, and at least one substrate. In certain embodiments, a porous membrane is used in assembling the fluidic device.

In other embodiments, a method comprises assembling a device, having multiple layers of multiple members, substrates, and membranes. The method further comprises adhering at least a first substrate to a first side of a member, the member defining a cavity configured to allow fluids to therethrough flow, wherein adhering at least a first substrate to the first side of the member forms at least three boundaries of the cavity.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

FIGS. 8A-14D are images that correspond to exemplifications of embodiments of the present invention.

DETAILED DESCRIPTION

Figure 1A:
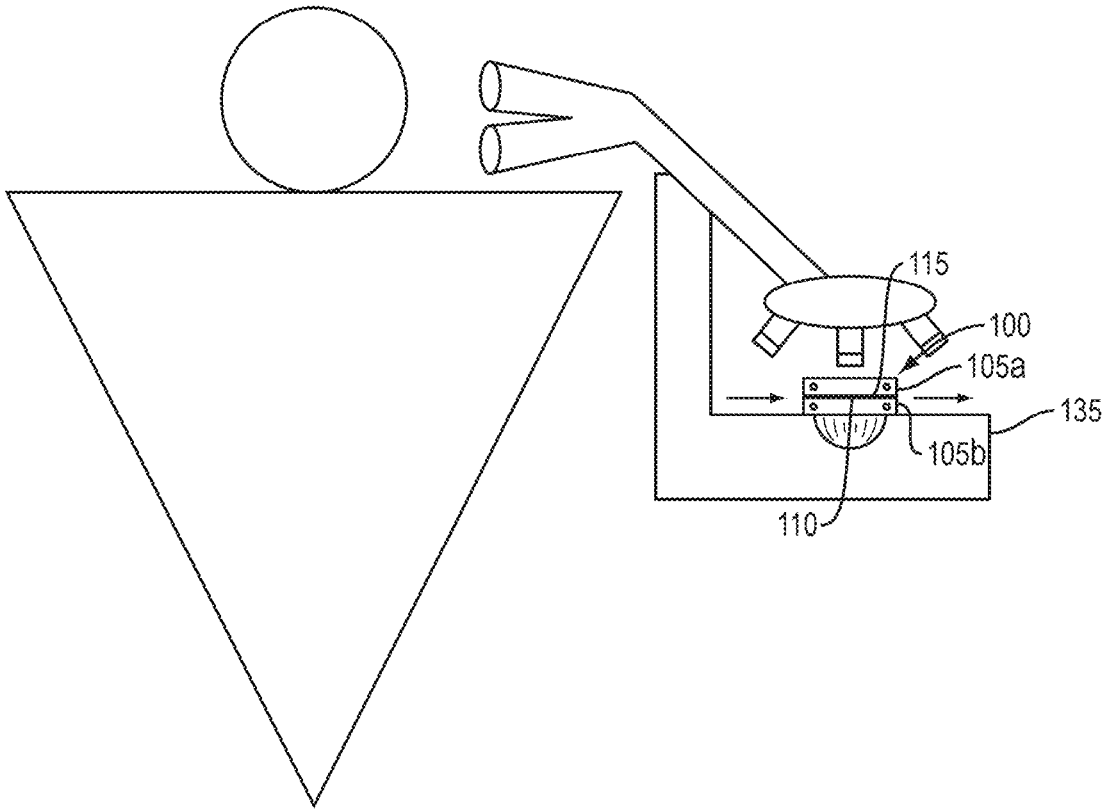
FIG. 1A is an illustration of an embodiment of an assembled fluidic device, optionally with a biological sample or other sample disposed therein, being observed by an individual through a microscope.

A description of example embodiments follows.

The teachings of all patents, published applications and references cited herein are incorporated by reference in their entirety.

The predominant form of fluidic devices used in developing cell cultures, the devices termed organs-on-chips, is a bi-layer design featuring two channels interfaced by a porous membrane or hydrogel. Culturing different cell types on opposing membrane surfaces or adjacent channels mimics heterogenous tissue-tissue interfaces. The bi-layer chip has been used to model the blood-brain barrier, a hematopoietic niche, the gut microbiome-epithelial-immune interface, the lung alveolar-capillary interface, and the placental barrier. Future devices integrating patient-derived cells may enable personalized medicine. Interconnecting multiple devices via an artificial circulatory system, termed body-on-a-chip, may permit in-vitro pharmacokinetics. Despite these advances, organs-on-chips have been mainly concentrated among bioengineering research groups. Chip automation and parallelization remains challenging, and complex, multi-layered (>2 layers) chips are limited.

There remains a need to develop a fluidic device and method for assembling multichannel devices for less cost and that resolves the fluidic device in a manner that solves the problem. In order to succeed commercially, organs-on-chips should be simple to use, automated, and support high throughput. Currently, organ-on-chip automation and throughput is limited by chip cost and fabrication complexity. Embodiments of the present invention provide users with rapid, facile, and inexpensive access to multilayer organs-on-chips and body-on-chips with standard fluidic connectors.

Embodiments provide flow paths for passage of fluid through a cavity in which biological interactions take place, resulting in cell growth and division. In an embodiment, such functionality is provided by a fluidic device that includes (1) at least one substrate, (2) a member that defines at least one boundary of the cavity and that is coated with or otherwise includes an adhesive compound, and (3) a cavity defined by the member, when coupled to the at least one substrate. Fluid may enter the device through an opening on the side of or on top or bottom of the fluidic device. The cavity through which fluid flows within the device is configured to be in fluidic communication with an opening or plenum and oriented to enable a fluid external from the fluidic device to enter the fluidic device. The device may be configured to have at least one flow path and to promote biological reactions and interactions once a fluid enters the device. Embodiments provide for biocompatible, thermoplastic chips that are water vapor impermeable, thereby eliminating evaporation-induced bubble formation and osmolarity shifts while potentially enabling $O_2$ tension control.

While example embodiments of the fluidic device described herein are presented in context to biological reactions and interactions, it should be understood that the embodiments may be used for other reactions, such as chemical reactions or for use in fluidic or microfluidic applications that do not perform a reaction within the device.

FIG. 1A depicts an embodiment of the invention implemented in the form of a fluidic device 100 in which a flow path 135 enables a biological reaction or interaction to occur within the fluidic device. The fluidic device 100 is configured to have at least one layer comprising a member 110 that defines a cavity 115 that may be fluidically coupled to a flow path 135. Another embodiment of the present invention is directed to the fabrication of the fluidic devices.

As should be appreciated, the fluidic device 100, in one embodiment is composed of as few as three components: a first substrate 105*a*; a member 110, that may include an adhesive compound on opposing sides and that defines a cavity 115; and a second substrate 105*b*. Because of its simplicity, the fluidic device may be assembled without complexity of high precision machinery or any machinery at all. Certain embodiments may dictate alignment of the substrates 105*a-b* such that flow paths(s) defined therethrough or plenum(s) defined therethrough align with the cavity 115 or cavities of the member 110. Once aligned, the substrates 105*a-b* are adhesively coupled to the member 110, and a flow path 135, which includes the cavity 115 as a portion thereof, is formed. The substrates 105*a-b* and the member 110 may be liquid and gas impermeable to contain all fluids within the flow path 135. Thus, a basic embodiment and more complex embodiments described below herein benefit from a dual purpose of the member 110, which is to serve as both a coupling mechanism for the first and second substrates 105*a-b* and a structure that, in combination with the first and second substrates 105*a-b*, defines at least a portion of the flow path 135. The benefits include low cost of manufacture, assembly, and materials of the resulting fluidic device 100.

Figure 1B:
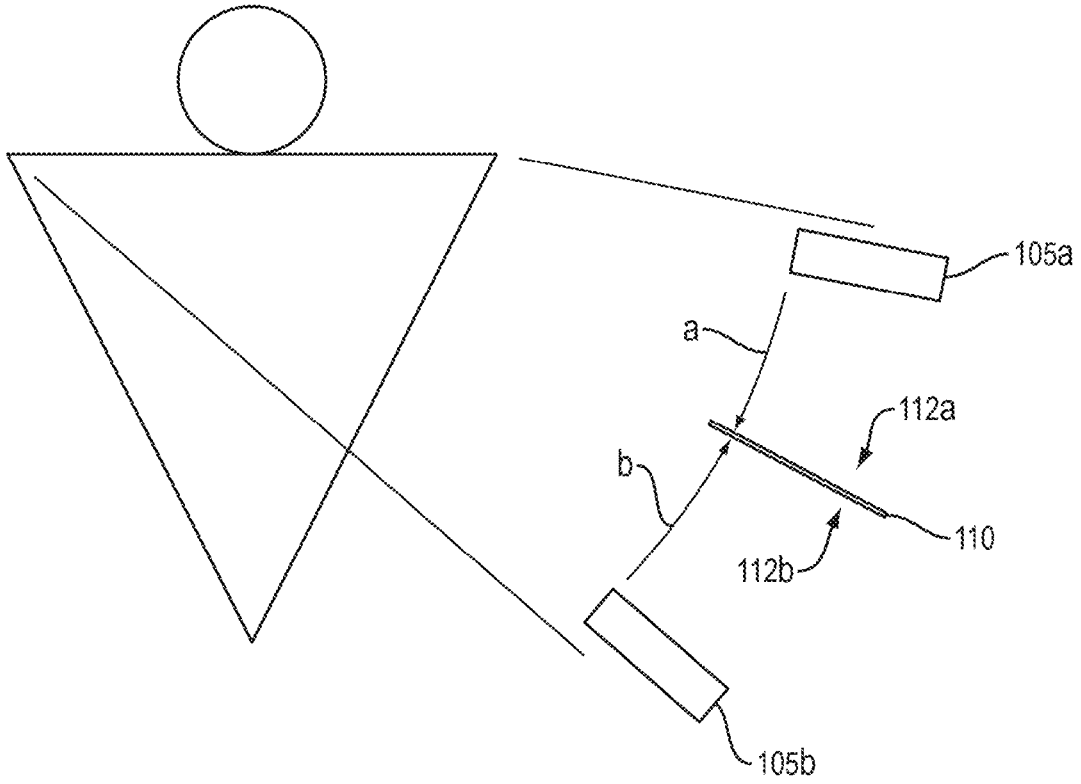
FIG. 1B is an illustration of the fluidic device's disassembled components and a mechanical schematic diagram showing a method in which an individual may couple components together to assemble the device.

FIG. 1B depicts an unassembled fluidic device 100, comprising three main components: (1) the first substrate 105*a*, (2) the second substrate 105*b*, and the member 110. The assembly process depicted in FIG. 1B, through the schematic showing a direction a of the first substrate 105*a* and direction b of the second substrate 105*b* moving towards first and second sides 112*a-b* of the member 110 having an adhesive compound on opposing sides, respectively. The manufacturing process involved with respect to the member 110, prior to fluidic device 100 (also referred to herein as a chip) assembly, may involve a rapid cut and assemble process, which may employ a laser cutter or engraver, the member with an adhesive compound on opposing sides, a poly(methyl methacrylate) (PMMA) sheet, and a polyester (PET) sheet.

For a prototyped embodiment, chip layers were designed using computer software. A laser cutter was used to transfer the design, developed using the software, onto the respective materials. The first substrate 105*a* featured four plenums (not shown in FIGS. 1A-1B), serving as inlets and outlets for upper and bottom fluidic layers. The member 110 with an adhesive compound on opposing sides featured a cavity defining a fluidic channel, optimally used for cell culture, and cavities defining inlets and outlets (not shown), which are on diagonally opposing sides of each other, in communication with a respective fluidic channel. In some embodiments, the inlets and outlets matched a two-dimensional parameter of the plenums featured in the layer (e.g. first substrate) coupled to the first side 112*a* of the member 110. The second substrate 105*b* was coupled to the second side 112*b* of the member 110.

Embodiments provide numerous advantages and features over existing methods for manufacturing fluidic devices. In particular, embodiments may utilize a cut and assemble method for manufacturing thermoplastic fluidic devices. The technique can produce multilayer devices faster than existing methods, such soft lithography, and at a minimal cost (roughly $2 per device) without specialized bonding. In one embodiment, the resulting biocompatible, thermoplastic devices may be water vapor impermeable, thereby eliminating evaporation-induced bubble formation and osmolarity shifts, while potentially enabling $O_2$ tension control.

The cut and assemble method was validated by reengineering intestinal monolayers and further developed organoids using the fluidic devices embodied by the present invention. For example, when used with Caco-2 cells and primary human intestinal organoids, Caco-2 cells and primary organoids cultured in a bi-layer chip formed confluent monolayers expressing tight junctions and low permeability comparable to static well-plate controls. Furthermore, Caco-2 cultures on chip differentiated four times faster toward an enterocyte phenotype as compared to controls and produced mucus. For the first time, primary intestinal monolayers and 3D intact organoids have been integrated in a novel, dual membrane, tri-layer organ chip. Monolayers formed villus-like tissue growth spanning $10^2$ μm in height and organoids formed typical cystic structures in close proximity to monolayers, potentially enabling paracrine signaling. The rapid, benchtop fabrication process of some embodiments of the present invention has great potential toward microphysiological models of multicellular tissues featuring cell monolayer-extracellular matrix (ECM) interfaces and paracrine signaling.

Another example method for assembling the fluidic device of the present invention comprises a rapid cut and assemble manufacturing process, employing only a laser cutter/engraver, a member with an adhesive compound on opposing sides, and at least one substrate. In certain embodiments, a porous membrane is used in assembling the fluidic device. In other embodiments, methods comprise the assembly of a device having multiple layers, including of multiple members and substrates, and membranes are used in assembling the fluidic device. The example method may further comprise adhering at least a first substrate to the first side of member, the member defining a cavity, in combination with the substrate(s), configured to allow fluids to flow therethrough.

Another example method for assembling the fluidic device of the present invention may comprise providing a member with a cavity defined therein. The member may include an adhesive compound on opposing sides, providing a means of adhering first and second substrates to the member, thereby forming a flow path. The method may further comprise arranging the first substrate on a first side of the member and a second substrate on a second side of the member with an orientation that enables fluids external from the first and second substrates to flow into or out of the cavity. The adhesive compound on opposing sides of the member couples the first and second substrates to the member in the orientation to form the fluidic device with the cavity defined therein.

The device yields economic viability and efficiency through ease of production, costing a total of approximately $2 per chip. The ease of producing the device may allow for high throughput manufacturing. The fluidic device provides for faster cell growth and differentiation, in comparison to other technologies used for a similar purpose (e.g., multi-well-plates), but those other technologies cost significantly more to produce than the cost associated with producing the fluidic device of the present invention.

The methods of assembling and forming the fluidic device of the present invention may be employed to the embodiments described herein. FIGS. 2A-2D illustrate components and assembly thereof in greater detail.

Figure 2A:
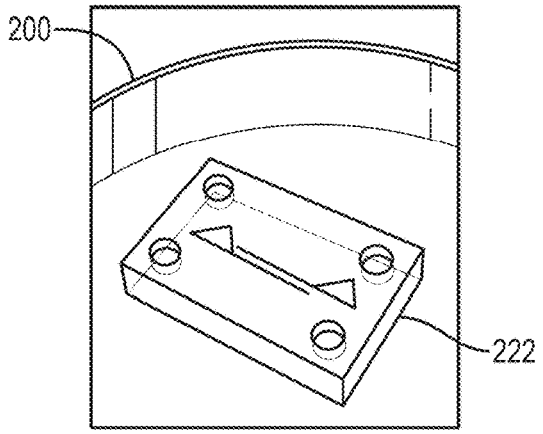
FIG. 2A is an image depicting a fully assembled multilayered fluidic device.

FIG. 2A depicts an embodiment of a fluidic device 200 with multiple layers and multiple membranes. The device depicted in FIG. 2A features a specimen port 222, to enable a user to deposit a specimen into an assembled fluidic device 200. In certain embodiments, the specimen port is configured to serve as an inlet for gel mediums. In other embodiments, this port is configured to serve as an inlet for biological samples, including, but not limited to, stem cell samples. Embodiments of the present invention may have fluidic devices that have substrates that are clear, opaque, or light impermeable. Examples include poly(methyl methacrylate) (PMMA), acrylic, polycarbonate track etched membrane, and glass compounds, ceramic, metal, and other materials used in the art that provide some interactive or no interactive properties with the sample to be deposited or fluid to be flowed into the fluidic device. Notably, clear materials enable a user to view fluids, gels, or solids in the fluidic device or apply a light source to irradiate the sample with a stimulating light source, for example.

Figure 2B:
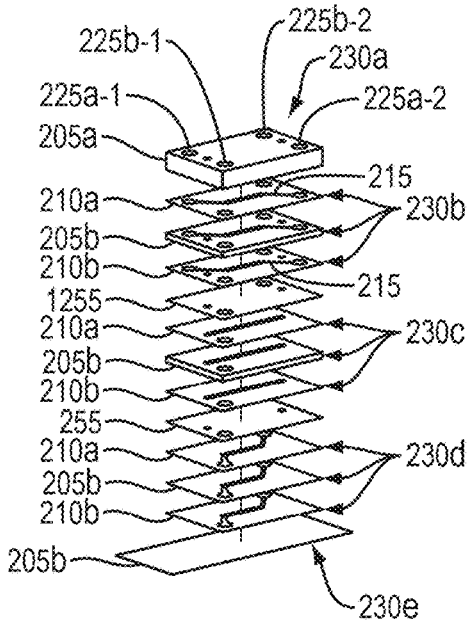
FIG. 2B is an exploded view of the device of FIG. 2A.

FIG. 2B is an exploded view showing the integration of thirteen discrete layers that form the device depicted in FIG. 2A. The view depicts: (1) a first layer 230*a*, featuring a first substrate 205*a* with four plenums (shown in more detail in FIG. 2C) 225*a*-1, 2 and 225*b*-1, 2, which serve as pairs of fluidic inlets and outlets (shown in more detail in FIG. 2C) for flow paths formed by the cavity defined by the member with which the plenums are configured to be in fluidic communication; (2) a second layer 230*b*, featuring an inner substrate 205*c* sandwiched in-between two members 210*a*-*b* defining cavities 215 forming fluidic channels and volumes corresponding to and, in some embodiments, with identical or similar measurements as the fluidic inlets and outlets, both members 210*a*-*b* having identical cavities in some embodiments; (3) a porous membrane 255 having size dimensions identical or similar to the upper layer components (i.e., inner substrate 205*c* and corresponding members 210*a*-*b*) and central inlet cavities identical in size and alignment to the corresponding plenums in the upper and lower layer components; (4) a third layer 230*c*, featuring an inner substrate 205*c* coupled on its first and second sides (i.e., upper and lower surfaces) to two members 210*a*-*b*, one member on each side of the inner substrate 205*c*, both of which are coupled to a porous membrane 255, the members and substrate defining a cavity (not shown) forming a flow path (not shown) in the center of the third layer 230*c*; (5) a fourth layer 230*d*, featuring an inner substrate 205*c* coupled on its first and second sides to a first and second member 210*a*-*b*, the first member 210*a* being directly coupled to the porous membrane 255 of the third layer 230*c*, the fourth layer 230*d* reflecting the second layer 230*b* but reflected 90°, the members 210*a*-*b* and substrate defining a cavity (not shown) that defines a flow path; (6) a porous membrane 255 situated in between the second layer 230*b* and third layer 230*c*; and (7) a fifth layer 230*e* featuring a second substrate 205*b* coupled to a second member 210*b* that is coupled to the inner substrate 205*c* in the fourth layer 230*d*.

Figure 2C:
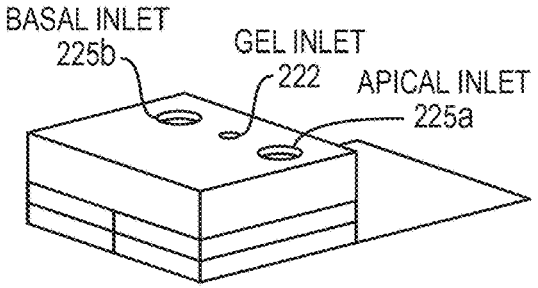
FIG. 2C is a cross-sectional view of the device of FIG. 2A, depicting the cavities through which fluids may flow and plenums through which fluids may be introduced into the device.

FIG. 2C is a cross-sectional view of a fully assembled multilayered fluidic device. The device features a first plenum ("basal inlet") 225*a*, second plenum ("apical inlet") 225*b*, and a specimen port ("gel inlet") 222, via which different samples can be introduced into the fluidic device. The plenums 225*a*-*b* and the specimen port 222 are configured to be in fluidic communication with their respective fluidic channel defined by the layers in FIG. 2B. The descriptions of basal inlet, apical inlet, and gel inlet refer to terms for a given application in which the fluidic device 200 may be employed.

Figure 2D:
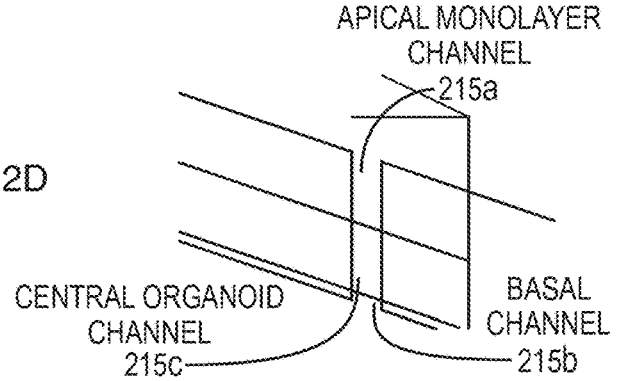
FIG. 2D is a zoomed-in view of the cross-sectional view of FIG. 2C that illustrates cavities or flow paths defined by components of the device.

FIG. 2D is a zoomed-in view that depicts the first cavity 215*a*, second cavity 215*b*, and third cavity 215*c*, which form flow paths (not shown) to the plenums 225*a*-*b* and the specimen port 222. The plenums 225*a*-*b* depicted in FIGS. 2A-2D are configured to be in fluidic communication with the cavity in the fluidic device, which provides a portion of a flow path through which fluids may travel. The fluidic device 200 with flow paths defined therein enables fluids external from the device to enter through the plenums, which can also be referred to as inlet plenums, travel through plenums to the member defining a cavity, with which plenums are in fluidic communication, pass through the cavity and into respective output plenums.

Figure 3:
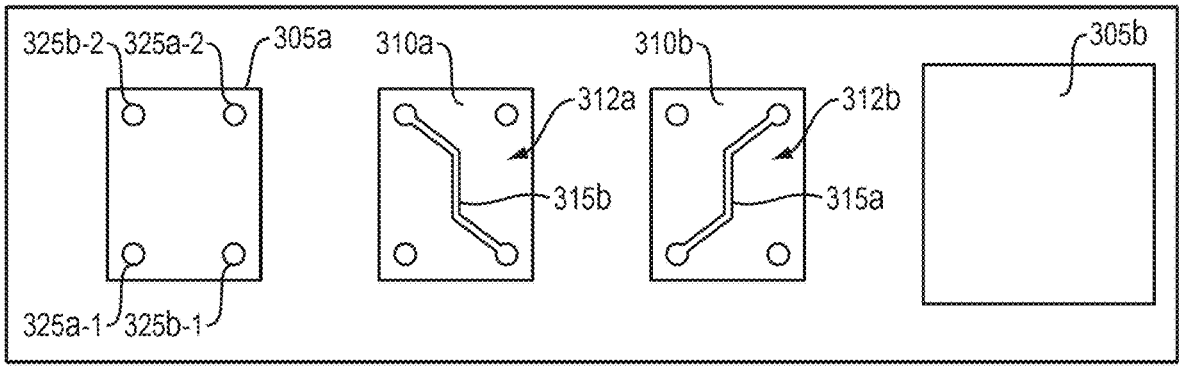
FIG. 3 is a topological view depicting a single-layered fluidic device's components and the partitions therein.

FIG. 3 is a cross-sectional view of the components of a bi-layered fluidic device 300. In this embodiment, the fluidic device (not shown) features a first substrate 305*a*, a first member 310*a*, a second member 310*b*, and a second substrate 305*b*. The first substrate 305*a* has four plenums (plenum 325*a*-1, plenum 325*a*-2, plenum 325*b*-1, and plenum 325*b*-2) that traverse (i.e., span vertically through or otherwise provide a flow path through) the first substrate and fluidically communicate with the first member 310*a* and second member 310*b*. The plenums in the first substrate 305*a* are designed to be fluidically coupled to corresponding cavities 315*a* or 315*b* in the members to which the substrate 305*a* is mechanically coupled, directly or indirectly.

In the example of FIG. 3, during assembly of the fluidic device in which the member 310*a*, 310*b* are translated horizontally, by an assembler or end user performing the assembly, to their "stacked" position to form the fluidic device, the first substrate 305*a* is mechanically coupled to the first side 312*a* of the first member 310*a*, and the second substrate 305*b* is mechanically coupled to the second side 312*b* of the second member 310*b*. Then, during operation, fluid (not shown) may be flowed by a user into an inlet of a pair of plenums, such as inlet plenum 325*a*-1 of the pair of plenums 325*a*-1,2, and the fluid will flow into and through the respective cavities.

Figure 4A:
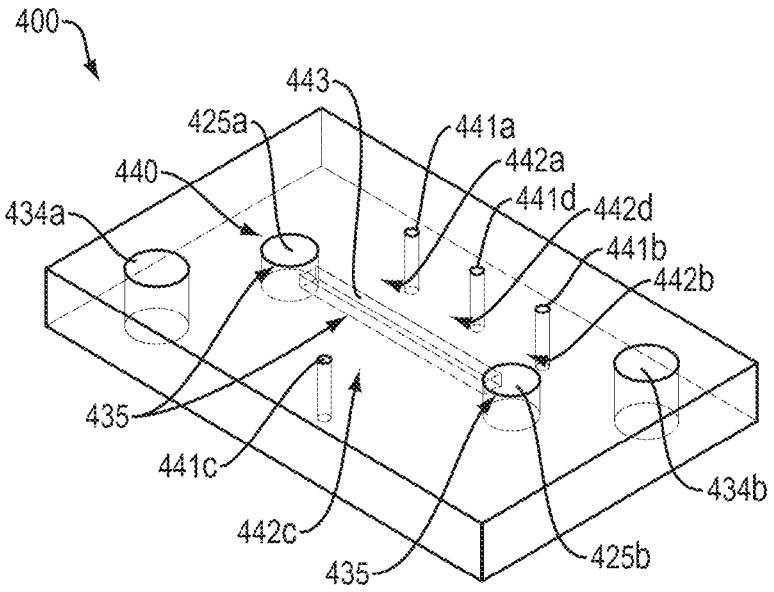
FIG. 4A is a 3D view depicting a fluidic device having a compartment with sub-compartments configured to hold biological samples.

FIG. 4A is a 3D view of an assembled fluidic device 400 with multiple layers (individual layers not shown). In this embodiment, a substrate or layer(s) between substrates defines a compartment 440. The fully assembled fluidic device 400 contains plenums 425*a*-*b* that are in fluidic communication with member(s) defining respective cavities. Alignment holes 434*a*-*b* are configured to enable hardware (e.g., screws) hold the fluidic device 400 in place to a benchtop or other structure (not shown) and do not play a role in defining the flow path 435.

The plenums 425*a*-*b* traverse substrate(s) and are in fluidic communication with the cavity 415, which, in the assembled fluidic device 400, is aligned with the compartment 440. The fluidic device 400 may be configured to enable fluids external from the fluidic device to enter the compartment 440 through the plenum 425*a* and through ports 441*a*-*d*. A fluid may be deposited into the compartment 440 through a first port 441*a* and may then enter a subcompartment 442*a*. Fluids may be deposited into the compartment through a second port 441*b* and may then enter a second subcompartment 442*b*. A ventilation subcompartment 442*d* may be configured to enable ventilation through a ventilation port 441*d*, which enables a phase guide 443 to compartmentalize fluids deposited in the first subcompartment 442*a* and second subcompartment 442*b* and to prevent the fluids from interacting with each other. A third fluid may be deposited into a third subcompartment 442*c* via a third port 441*c*. In certain embodiments, the fluidic device 400 may be configured to hold three different fluids. In other embodiments, the device 400 may be configured to hold three similar fluids.

Other numbers of fluids and supporting structures in the fluidic device 400 are contemplated in other embodiments. The fluidic device 400 features multiple separate channels (not shown) and porous membranes (not shown). The porous membrane enables fluidic diffusion between two adjacent channels (not shown), mimicking circulation and forming a flow path 435.

The substrates (not shown) may enable one or many environmental stimuli to activate the interaction between the biological samples and/or a medium within the compartment 440, where example environmental stimuli include light irradiation, temperature change, enzymatic catalysts, or the introduction of a reactive compound or drug. Mimicking circulation or performing other biomimicry enables studying physiologically relevant 3D cell cultures, recapitulating the in vivo environment, while avoiding the inherent complexities and variability of in vivo counterparts. In non-biological applications, use of the membrane between adjacent cavities, flow paths, compartments, or combinations thereof can be used for respective studies.

Figure 4B:
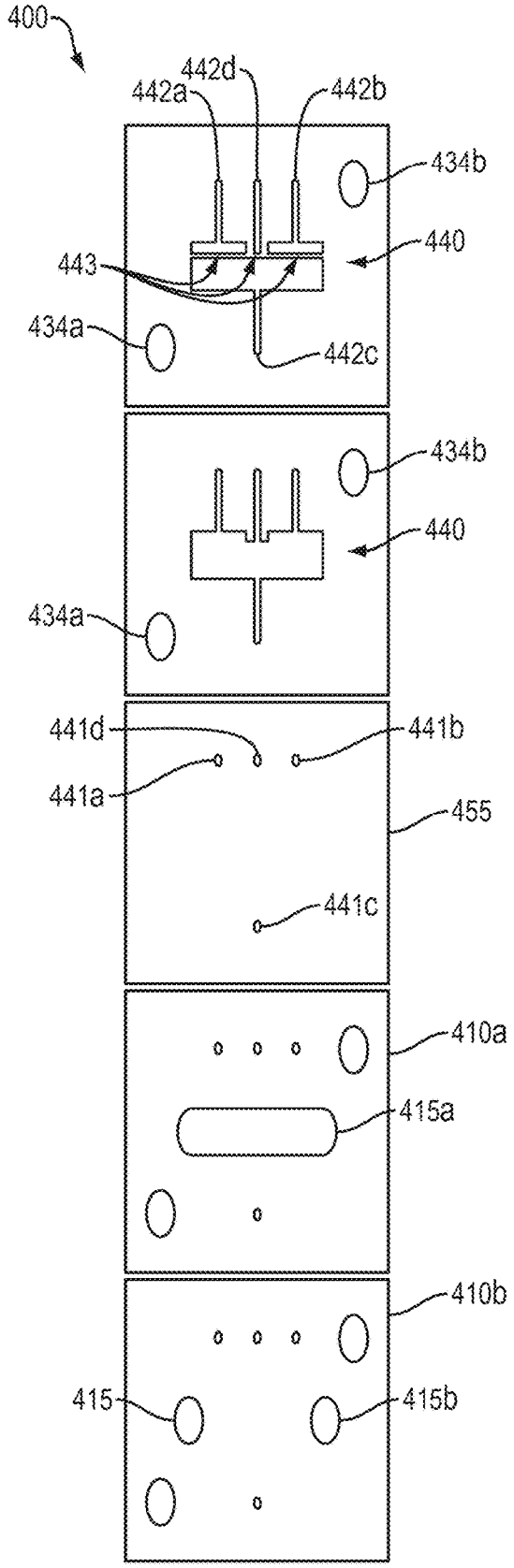
FIG. 4B is a 2D view depicting the separated components of a fluidic device having a compartment with sub-compartments, a phase guide, and membrane layers.

FIG. 4B is cross-sectional view of the separate components of the fully-assembled fluidic device 400 of FIG. 4A. A topical view of the fully assembled device 400 shows the compartment 440, the phase guide 443, two alignment cavities 434*a*-*b*, three sample subcompartments 441*a*1-*c*1, and a ventilation compartment 442*a*. The device 400*a* comprises at least a first substrate 405*a*, a first member 410*a*, a second member 410*b*, and a porous membrane 455. The first and second members define respective cavities, which, when coupled to at least a first substrate 405*a*, form a compartment 440 with a series of subcompartments 442*a*, 442*b*, and 442*c*. The at least first substrate may be coupled to the first side (not shown) of the first member 410*a*, forming the compartment 440. The porous membrane 455, first member 410*a*, and second member 410*b* define cavities, which, when the fluidic device is fully assembled, may form ports 441*a*-*c*, through which fluid may be deposited and then flow into respective subcompartments 442*a*, 442*b*, or 442*c*. The members 410*a*-*b* and the porous membrane 455 may further define cavities, which, when the fluidic device is assembled, form a ventilation port 442. The members 410*a*-*b* may also define alignment cavities 434*a*-*b*, which may hold or secure the device in a desired configuration and/or location.

Figure 5:
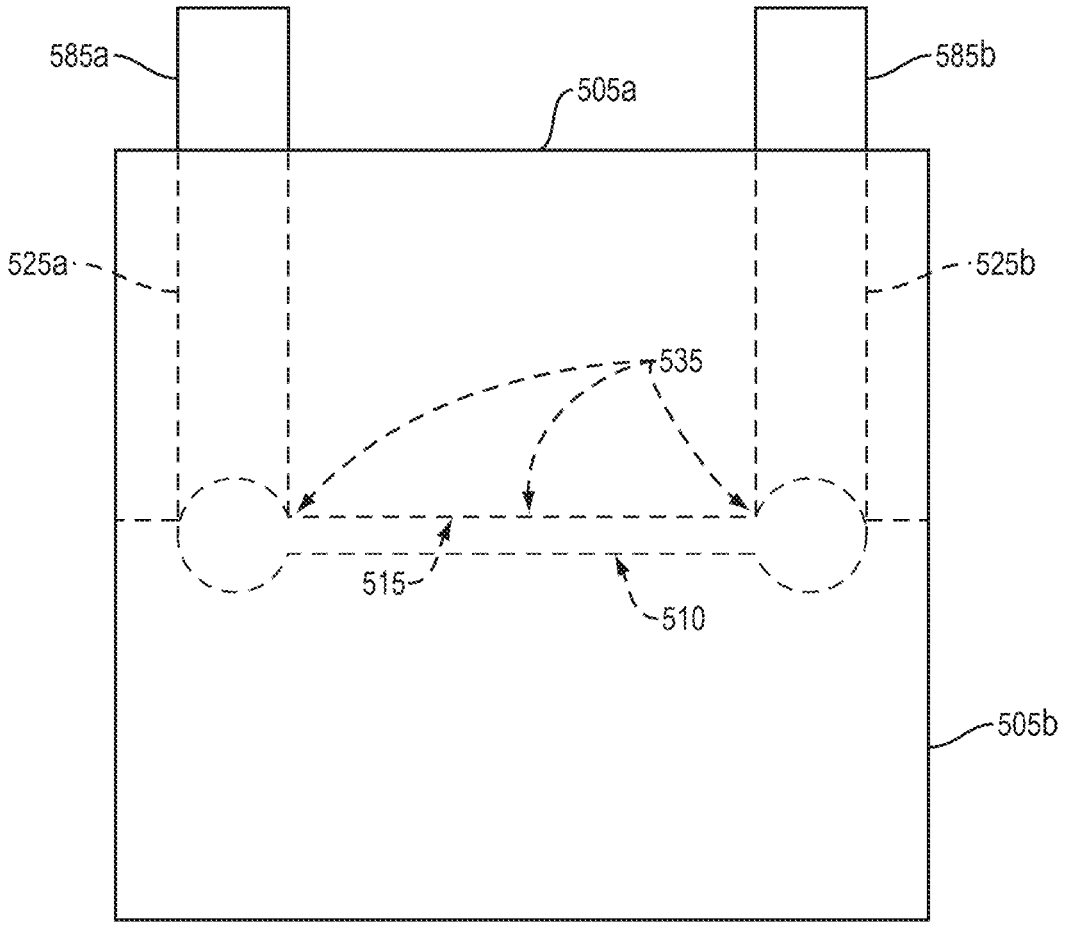
FIG. 5 is a diagram illustrating a cross-sectional view of the fluidic device integrated with sensors that are in fluidic communication with the cavity.

FIG. 5 is a cross-sectional view of the fluidic device depicting plenums 525*a*-*b* configured to allow respective sensors 585*a*-*b* to traverse a substrate 505*a* and communicate with (i.e., observe a given state within or at) a member 510 defining a cavity 515, whereby the plenums 525*a*-*b* are in fluidic communication with the cavity 515, and wherein the cavity 515 defines at least a portion of the flow path 535. The plenums 525*a*-*b* are configured to be in fluidic communication with the member 510 defining a cavity 515, therein forming a flow path 535 through which fluids may travel. In certain embodiments, the fluidic device 500 may be configured to form a flow path 535 by enabling fluids external from the device to enter the cavity 515 via a first plenum 525*a*, which can also be referred to as the inlet plenum, which may be in fluidic communication with the cavity 515. In this embodiment, fluids may pass through the cavity 515 and into a second (outlet) plenum 525*b*, which is also configured to be in fluidic communication with the cavity 515, whereupon the fluid may flow through cavity 515 and into the outlet plenum, whereupon the fluid may exit the fluidic device.

In operation, the sensors 585*a*-*b* may be used to detect any changes in a flow path, cavity, or compartment within the fluidic device 500 or in the environment within or adjacent to the fluidic device 500 that is due to environmental alterations, stimuli, or cues, all of which can be referred to as environmental triggers. In certain embodiments, the environmental trigger may comprise a change in pH. In certain embodiments, the environmental trigger may comprise a change in temperature. In other embodiments, the environmental trigger may be the presence of extracellular deoxyribonucleic acid (DNA).

Examples of sensors include thermal sensors, pressure transducer-based sensors, electrodes, DNA sensors, antibody-based sensors, other known forms of biological sensors, chemical sensors, and so forth. In some embodiments, the thickness of the sensors and substrate (e.g., flexible circuitry or film) on which the sensor or transducer portion of the sensor is in the same order of magnitude as a thickness of the member, membrane, or substrate. In alternative embodiments, the thickness can be thicker or thinner. Material(s) from which a sensor is made may be chosen such that the material(s) do not interfere with a reaction the sensor or transducer is being used to observe.

Figure 6:
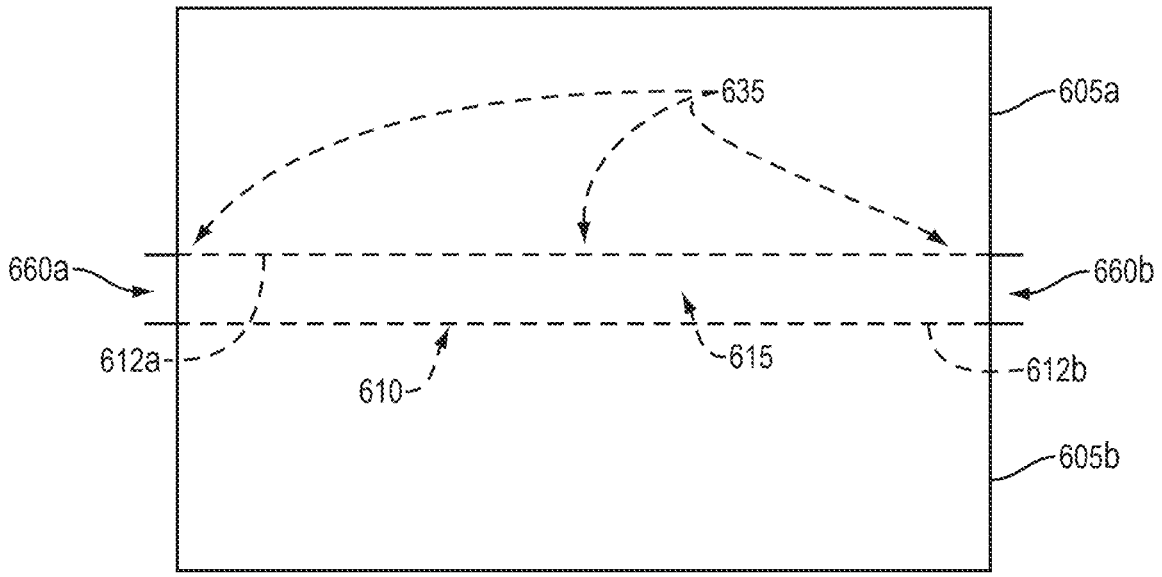
FIG. 6 is a diagram illustrating an embodiment of the fluidic device, in which there are openings on each end of the device in-between first and the second substrates, leading to a cavity therein, forming a flow path that spans a length of the device.

FIG. 6 illustrates another embodiment in which the fluidic device may comprise a first substrate and a second substrate coupled to a member defining a cavity extending a length of the fluidic device. In particular, FIG. 6 depicts a fluidic device 600 comprising a first substrate 605*a* and a second substrate 605*b* coupled to the first side 612*a* of a member 610 and second side 612*b* of the member 610, respectively, the member 610 defining a cavity 615 that forms a flow path 635 spanning a length of the device 600. The openings 660*a-b* at opposing lateral ends of the device 600 may be configured to enable fluids external from the device 600 to enter the device through an opening 660*a* that is in fluidic communication with the cavity 615 and to pass through the device, forming a flow path 635. In certain embodiments, the device may be configured to enable fluids external from the device 600 to enter the cavity 615 through the opening 660*a* via a synthetic or organic vessel (not shown). In certain embodiments, the passage of fluids through a vessel may be actively induced, whereby a synthetic component (not shown) may fluidically communicate with the cavity 615 defined by the member 610 of the fluidic device 600 via the opening 660*a* and the exit 660*b* and may simultaneously fluidically communicate with the fluidic device's environment. In other embodiments, the passage of fluids through a vessel in fluidic communication with the fluidic device 600 via the opening 660*a*, and the exit 660*b* may be passively induced, whereby an organism's natural circulatory system may induce fluid to flow into the fluidic device 600 in the absence of coupling the device 600 to a synthetic vessel through which fluids may pass. In another embodiment, the fluidic device 600 is configured to enable fluids external to the fluidic device to enter the cavity through the opening 660*a* by means of affinity towards a compound (not shown) inside or adjacent to (not shown) the opening 660*a* of the fluidic device 600.

Figure 7:
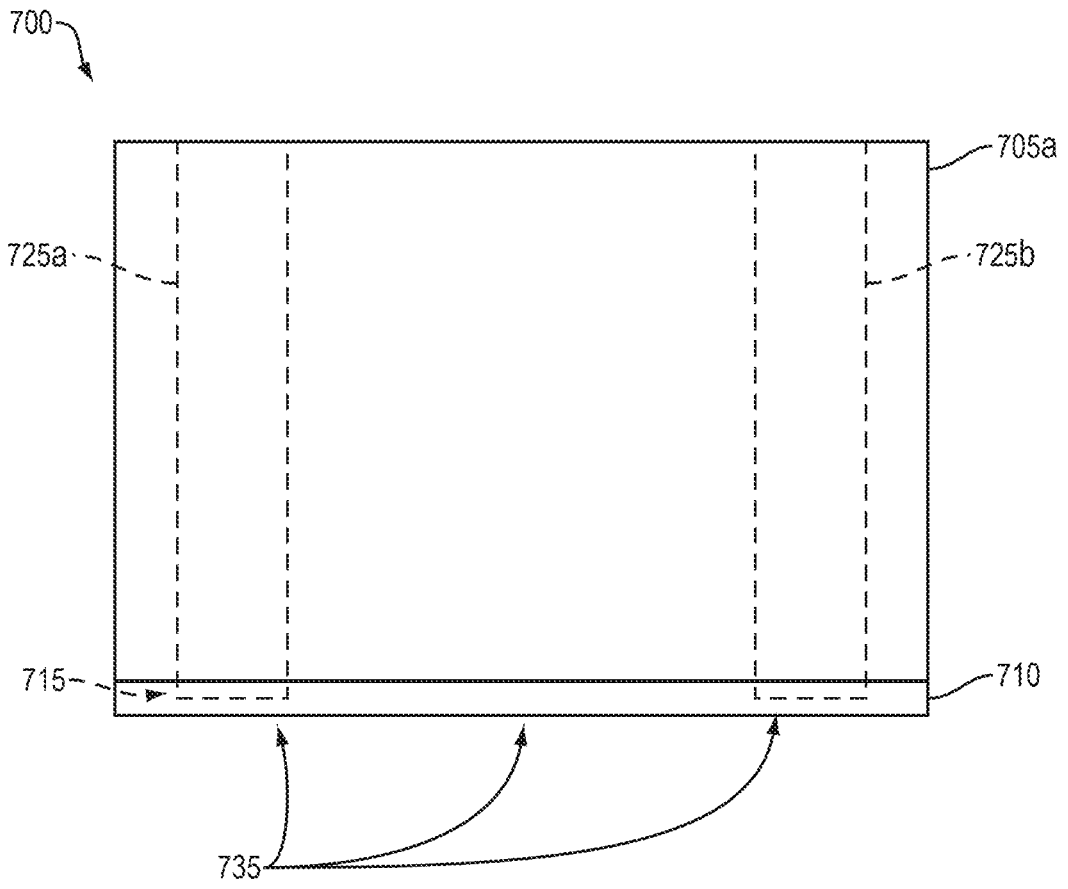
FIG. 7 is a cross-sectional diagram illustrating an embodiment of the fluidic device in which a single substrate is coupled to one side of a member.

In another embodiment, a fluidic device may comprise a substrate coupled to a member and plenums traversing the substrate, the plenums configured to be in fluidic communication with the member defining a cavity. FIG. 7 depicts a fluidic device 700 that includes a first substrate 705*a* coupled to one side 712*a* of a member 710 defining a cavity 715. At least two plenums 725*a-b* traverse the substrate 705*a* and are in fluidic communication with the cavity 715 defined by the member 710. The plenums 725*a-b*, configured to be in fluidic communication with the cavity 715, form a portion of a flow path 735 through which fluids may travel. In certain embodiments, a fluidic device 700 may be configured to form a flow path 735 by enabling fluids external from the device to enter through a first plenum 725*a*, travel to the cavity 715, with which the first plenum 725*a* is in fluidic communication, pass through the cavity and into a second plenum 725*b*, which is in fluidic communication with the cavity, whereupon the fluid flows out of the device through the second plenum to an environment external from the fluidic device 700.

In another embodiment, a fluidic device 700 comprises one substrate 705*a* coupled to one side 712*a* of a member 710, the member defining a cavity 715 defining the entire portion of the flow path 735. Fluid may enter the device 700 at an opening 760*a* on one side of the device that leads into the cavity 715 at one end (not shown) of the device and then may exit the cavity at a second opening (not shown) on the opposing side of the device. In certain embodiments, a fluidic device 700 may be used in vivo in hard-to-reach areas or small regions of an organism. In certain embodiments, a fluidic device 700 may be configured to enable fluids external from the device to enter a cavity 715 defined by a member 710 through an opening (not shown) via a synthetic or organic vessel (not shown) in fluidic communication with at least one opening that is in fluidic communication with the cavity defined by the member. In another embodiment, a fluidic device 700 may be configured to enable fluids external from the fluidic device to enter a cavity 715 through at least an opening (not shown) by means of affinity to a compound (not shown) inside or adjacent to at least the opening of the device.

Figure 8A:
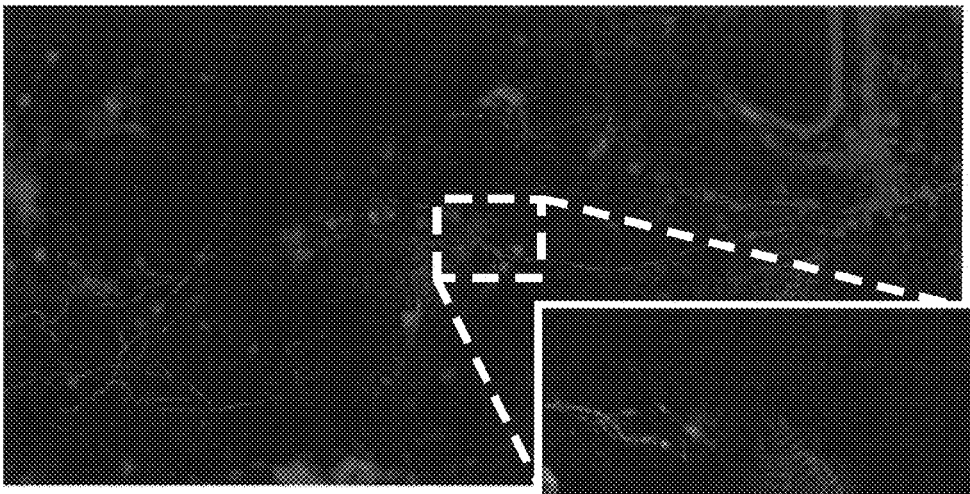
Figure 8B:
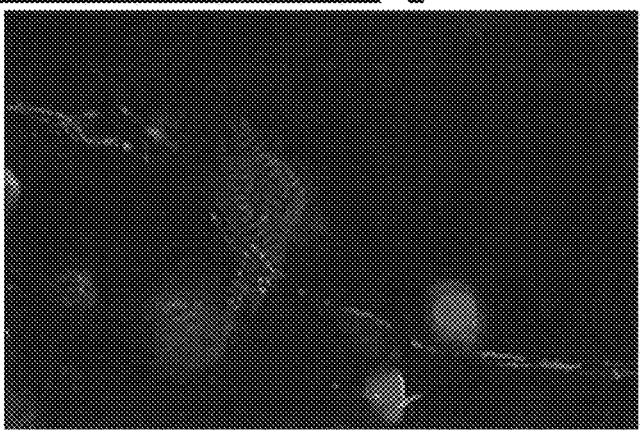

Exemplification 1: Engineering a Physiologically Relevant Model of the Cardiac Autonomic Nervous System FIGS. 8A and 8B are photographs of primary rat sympathetic neurons (green: neurofilament-200) innervating a 3D cardiac microtissue containing primary CMs (red: saracomeric α-actinin; blue: DAPI).

In recapitulating the autonomic nervous system (ANS) innervation into cardiac tissue, using a commercially available chip (DAX1, AimBiotech), an embodiment of the present invention has been used to encapsulate cardiac cells successfully in a biomimetic gelatin scaffold in situ and observed sympathetic nervous system (SNS) innervation. However, a standard fluidic device does not support the 3D encapsulation and compartmentation of the neural components of the cardiac ANS. Therefore, a custom laser cut microfluidic chip was fabricated to support 3D compartmentalized cell culture of cardiac cells and both ANS neuron populations. Notably, this fluidic device design permits neurons to be encapsulated a day prior to addition of cardiac cells, which allows for the necessary handling time of each cell population. Additionally, the fluidic device contained a tight and well-defined hydrogel boundary between compartments so that innervation would be unobstructed and easier to quantify (not shown).

There is a demonstrated ability to measure cardiac output (beat rate and beating synchrony) of encapsulated cardiac cells cultured in fluidic devices using video microscopy. Further, cardiac cells encapsulated using a custom visible light crosslinking platform have significantly greater cell viability compared to systems using UV light for cardiac cell encapsulation. Experiments may be performed to incorporate the primary SNS and PSNS neurons in situ to investigate their rate of innervation, in addition to how their spontaneous firing will affect cardiac output. This development of a physiologically relevant model of the cardiac ANS will enable the systematic investigation of novel therapies to promote/prevent the intervention of different neural populations, in addition to improving our understanding of cardiac dysautonomia.

Exemplification 2: Caco-2 Cell Culture

Caco-2 epithelial cells were obtained from the American Type Culture Collection (ATCC) and cultured in Dulbecco's Modified Eagle Medium (DMEM, cat no. 11995-065, ThermoFisher) supplemented with 10% fetal bovine serum (FBS, cat no. 35-011-CV, Corning), and 100 U/mL Penicillin-Streptomycin (cat no. 15140122, ThermoFisher). Cells were cultured in a 37° C., 5% $CO_2$ incubator. All experiments were done with Caco-2 cells between passage numbers 40-50.

After fabrication, the bi-layer fluidic device was sterilized via UV irradiation (300 mJ/cm$^2$) of the top and bottom chip surfaces (Spectrolinker XL-1000, Spectronics Corporation, Westbury, N.Y.). All tubing and fittings were preassembled and sterilized via autoclave. Both apical and basal fluidic channels were coated with a solution of a 400 μg/mL solution of rat tail type I collagen (cat no. 354249, Corning, Corning, N.Y.) in DMEM for at least one hour at 37° C. inside a humidified cell culture incubator with 5% $CO_2$. After 1 hour, the device and tubing were flushed with Caco-2 culture medium via a sterile, plastic syringe. Caco-2 cells were harvested from a sub confluent T75 flask via 0.25% Trypsin-EDTA (cat no. 25200056, ThermoFisher) and incubation at 37° C. After cell detachment, the Trypsin-EDTA was diluted with an equal volume of cell culture media and centrifuged at 300 g for 5 minutes at room temperature. The cells were suspended in cell culture medium at $5\times10^6$ cells/mL. The outlet to the bottom fluidic channel of the microfluidic chip was clamped and the harvested cells were infused into the top fluidic channel via a sterile 1 mL syringe. The fluidic devices were placed in a 37° C., 5% $CO_2$ cell culture incubator for 1-2 hours for cell attachment. Post cell attachment, culture medium was perfused through the apical channel via a syringe pump (PhD 2000, Harvard Apparatus, Holliston, Mass.) at a rate of 0.84 uL/min. The next day, culture medium was perfused through both the apical and basal channels at a rate of 0.84 uL/min.

As controls, Caco-2 cells were cultured on 0.4 μm polyester (cat no. 353095, Corning, Corning, N.Y.) Transwell™ inserts in a 24 well plate. Prior to cell seeding, the inserts were coated with 2004, of the collagen solution for at least 1 hour at 37° C. inside a humidified cell culture incubator with 5% $CO_2$. Caco-2 cells were seeded on the inserts by adding 200 uL of Caco-2 cell suspension (seeding density of $2.6\times10^5$ cells/cm$^2$) and then adding 600 uL of media to the basolateral compartment. The apical and basal cell culture medium was refreshed every other day.

Exemplification 3: Monolayer Culture of Primary Human Intestinal Epithelial Cells Polyester Transwell™ inserts in a 24-well plate were coated with 2004, of collagen solution for at least 1 hour at 37° C. inside a humidified cell culture incubator with 5% $CO_2$. Organoids were harvested for dissociation and monolayer seeding after 7-10 days of culture. Matrigel droplets were harvested and processed in Trypsin-EDTA as described above. The Trypsin-EDTA was then quenched via a 2:1 dilution with Caco-2 culture medium containing 10% FBS and the organoid suspension was triturated ~20× using a 1000 μL pipette tip to produce single cells and small organoid fragments. The cell suspension was filtered over a 40 μm cell strainer (cat no. 22-363-547, Fisher) into a 50 mL conical tube and pelleted at 300 g for 5 minutes at room temperature. The cells were resuspended in EM medium with 10 μM ROCK inhibitor. Transwell™ inserts were seeded using 200 μL of cell suspension (seeding density of $9.09\times10^5$ viable cells/cm$^2$) and then 600 μL of media+10 μM ROCK inhibitor was added to the basolateral compartment. ROCK inhibitor was used for the first 48 hours of cell culture and the apical and basal cell culture medium was refreshed every other day. Post 2 days under EM medium, the apical and basal medium was replaced with differentiation medium (DM) containing Advanced DMEM/F12+20% FBS+4 mM GlutaMAX supplement+100 U/mL Penicillin-Streptomycin. Apical and basal DM medium was replenished every 48 hours.

For seeding primary human intestinal epithelial cells on bi-layer fluidic devices, the cells were harvested as described above and suspended at a concentration of $10\times10^6$ cells/mL. Cell viability was assessed via trypan blue exclusion by incubating cells with an equal volume of 0.4% Trypan Blue Solution (15250061, ThermoFisher). Prior to seeding, the bi-layer fluidic device was treated with $O_2$ plasma (50 Watts, 30 s, pure $O_2$, March PX-250 Plasma System) and the substrate was bonded. Note that primary cells adhesion required a plasma treated membrane whereas Caco-2 cells adhered without plasma treatment.

The fluidic device was sterilized via UV irradiation as previously described. The fluidic device was coated with collagen solution for 2 hours after which the collagen was flushed with EM medium containing 10 μM ROCK inhibitor. The cell suspension was perfused through the apical channel and the fluidic devices were maintained under static conditions in a 37° C. humidified cell culture incubator with 5% $CO_2$ for 5-6 hours to enable cell attachment. Then, apical medium was perfused at 1.48 μL/min. Post 3 days under apical EM medium perfusion, the apical and basal EM medium was replaced with DM medium and apical perfusion continued at 1.48 μL/min for two more days. The basal medium was manually refreshed every 24 hours.

Exemplification 4: Alkaline Phosphatase Treatment

Alkaline phosphatase (AP) expression was measured using a commercial kit (AS-71109, AnaSpec, Fremont, Calif.). All kit components were prepared as specified by the manufacturer. Cell lysate from Transwell™ inserts was prepared as follows: medium was removed, and the inserts were washed two times with sterile PBS in both apical and basal compartments. Next, 200 μL of sterile 10× TrypLE™ Select (A1217701, ThermoFisher) was added to the apical side of each insert prior to incubation at 37° C. for ~15 minutes. Post detachment, the TrypLE™ from each insert was collected into a sterile centrifuge tube. Each insert was washed with 800 μL of sterile PBS into each respective centrifuge tube. The harvested cells were pelleted at 300 g for 5 min at room temperature and suspended with 150 μL of lysis buffer. The cells were washed once by repeated centrifugation and suspended in 150 μL of lysis buffer. A 10 μL aliquot of cell suspension was removed to quantify the cell number via hemocytometer. The cells were centrifuged and suspended in 0.2% Triton X-100 (AC327371000, Fisher Scientific) in lysis buffer. The cells were incubated for 10 minutes at 4° C. with agitation. Post 10 minutes, the cell suspension was centrifuged at 2500 g for 10 minutes at 4° C. The supernatant was used for the AP assay. 50 μL of the supernatant was moved to a well of a black, polystyrene, 96 well plate (12-566-620, Fisher Scientific). Then, 50 μL of the reaction mixture was added to each well and the plate was manually mixed for 30 seconds. After 30 minutes incubation at 37° C. and 50 μL of stop solution was added to each well. The plate was manually mixed for 30 seconds. The fluorescence was measured via plate reader (EnSight™, PerkinElmer) using 485 nm and 528 nm emission and excitation wavelengths, respectively. For Caco-2 on chip, the same protocol was used except that the 10× TrypLE™ and the subsequent PBS wash was infused via a sterile, plastic syringe to detach cells. The actual amount of AP was estimated by constructing a calibration curve with the kit supplied AP standard.

Exemplification 5: Paracellular Permeability Measurement

The apparent permeability coefficient for a 4.4 kDa, tetramethylrhodamine (TRITC) labeled dextran (cat no. T1037, Sigma-Aldrich) was determined by measuring transport across the Caco-2 cell monolayer. TEER values of cell monolayers were measured prior to the permeability assay and monolayers with TEER values below 165Ω×cm$^2$ were not used. For control Transwell cultures, 300 μL of 500 μM dextran in cell culture medium was applied to the apical compartment. 100 μL was immediately sampled from the apical compartment, transferred to a black, polystyrene, 96 well plate and stored in a 4° C. fridge. Transwells were maintained in a humidified, 37° C.+5% $CO_2$ incubator. 100 μL aliquots were sampled from the basolateral compartment every 30 minutes over 3 hours and 100 μL of fresh medium preheated to 37° C. was added to replace the aliquoted volume. The fluorescence intensity of the collected basolateral samples was measured at 557 nm and 576 nm emission and excitation wavelengths, respectively. The actual dextran concentration was determined via a calibration curve. The apparent permeability coefficient was calculated as specified. For Caco-2 on chip, the dextran solution was perfused through the upper channel and cell culture media was perfused through the lower channel at a rate of 0.84 μL/min. Aliquots were sampled from the lower channel every hour and stored in a 4° C. fridge. The apparent permeability coefficient for Lucifer Yellow (cat no. L0259, Sigma-Aldrich) across primary organoid derived monolayers on static inserts and bi-layer chips was determined as described above.

Exemplification 6: Monolayer Morphology and Mucus Production Measurement

Cell morphology was assessed by staining F-actin, nuclei, and ZO-1 tight junction protein. Monolayers were washed and stained at room temperature. All monolayers were washed three times with PBS and fixed in 4 v/v % formaldehyde (cat no. 28906, ThermoFisher) for 20 minutes. Post fixation, the monolayers were permeabilized in 0.1% Triton X-100 for 20 minutes and blocked overnight in 2 wt % bovine serum albumin solution (BSA, cat no. 97061-416 VWR). The next day, the monolayers were stained with anti-ZO-1 antibody (1:200, 1 hour, cat no. 339188, ThermoFisher), phalloidin (1:500, 1 hour, cat no. A22287, ThermoFisher), and DAPI (1:1000, 10 minutes, cat no. D1306, ThermoFisher) diluted in 1 wt % BSA solution. Transwell membranes were cut out and mounted on a standard glass slide and coverslip.

Mucus production was assessed by alcian blue and immunostaining for MUC2 protein. Monolayers were washed and stained at room temperature. For alcian blue staining, cell monolayers were washed three times with PBS and fixed with 4 v/v % formaldehyde for 20 minutes. Next, the cell monolayers were washed three times with PBS and stained for 20 minutes with a 1% alcian blue solution in 3% acetic acid (pH=2.5, cat no. 50-319-30, Fisher Scientific) that was filtered via a 0.1 μm syringe filter. Post staining, the cell monolayers were washed five times with PBS. For MUC2 immunostaining, the cell monolayers, were washed, fixed, permeabilized, and blocked as previously described. Mucin was detected via an anti-mucin 2 primary antibody (1:200, 1 hour, cat no. PA1-23786, ThermoFisher) and an Alexa Fluor 647 secondary antibody (1:1000, 1 hour, A-21244, ThermoFisher). For monolayers in the bi-layer chip, the protocol remained the same, but washes and stains were applied via syringe pumps to minimize monolayer damage.

Fluorescence microscopy was performed on a Zeiss Axio Observer.Z1 microscope equipped with an ORCA-Flash4.0 camera (cat no. C11440-22CU, Hamamatsu). Color images of alcian blue stained monolayers were obtained on an Olympus IX51 microscope equipped with an Olympus DP70 camera.

Confocal microscopy was performed on an LSM 710 confocal microscope (Zeiss) equipped with Zen software (Zeiss) using the Plan-Apochromat 10×/0.45 M27 objective. The 405-nm laser was used to excite DAPI. A 512×512 pixel scan format was used. Z-slices were acquired at 2.87-μm intervals with each slice representing the average of 8 scans.

Exemplification 7: Recapitulating the Human Intestine on Cut and Assembled Chips To assess biocompatibility, human intestinal Caco-2 cells were cultured in the cut and assembled bi-layer fluidic device under apical and basal medium perfusion. Prior to cell seeding, both cavities were coated with rat tail type I collagen to promote cell adhesion. The medium flow rate of 0.84 μL/min delivered a shear stress of 0.015 dyne/$cm^2$ across the epithelial monolayer as previous work suggested an intestinal lumen shear stress of 0.002-0.08 dyne/$cm^2$. Caco-2 cells were cultured for 5 days on a fluidic device and compared to cells grown on static Transwell™ inserts for 5 and 21 days. After these time points, the cells were fixed and stained for F-actin, tight junction protein ZO-1, and cell nuclei. Cells formed confluent monolayers with comparable morphology, F-actin expression and tight junctions under all three culture conditions. Importantly, Caco-2 cells formed confluent monolayers across the integrated membrane demonstrating suitability for studying epithelial barrier function. While laser cut, or cutter plotter processed adhesives were previously used to fabricate fluidic devices, these were analytical fluidic devices. This study demonstrates that acrylic based adhesive members are biocompatible elements that support human intestinal epithelial cell culture.

Figure 9:
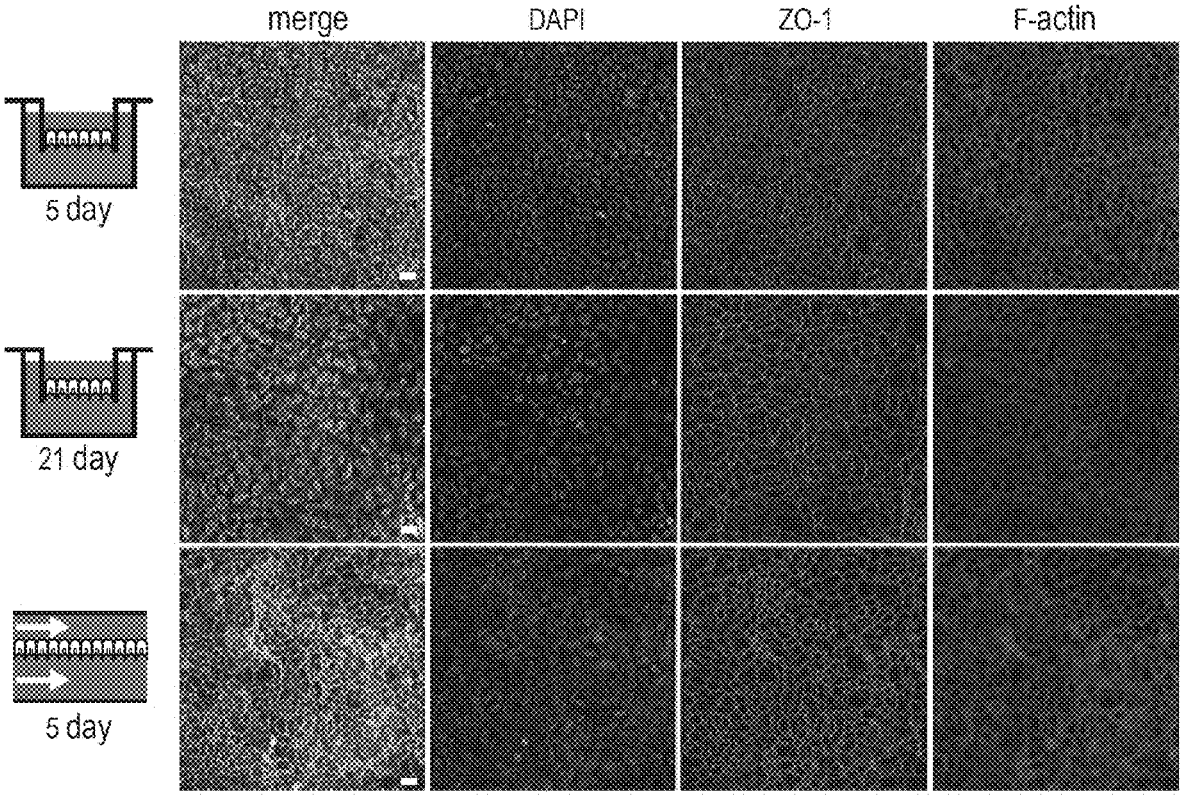

FIG. 9 is a matrix of images of an evaluation of biocompatibility of laser cut and assembled chips versus Transwell™ models. Cell morphology is visualized by immunostaining against ZO-1 tight junctions (green), DAPI nuclei (blue), and F-actin cytoskeleton (red) of Caco-2 cells grown on static Transwell™ inserts for 5 days (top), 21 days (middle), and on laser cut and assembled chips for 5 days (bottom). Scale bar denotes 20 μm.

Exemplification 8: Microfluidic Perfusion Culture Impacts Human Intestinal Function In Vitro Following biocompatibility validation of cut and assembled bi-layer chips, cellular function was assessed. As Caco-2 cells cultured on porous membranes are used to model intestinal transport, barrier integrity was quantified by measuring the apical-to-basal paracellular transport of a fluorescent dextran (4.4 kDa). Paracellular transport is governed by molecular diffusion through tight junctions rather than active transport via cell membrane bound transporters. The apparent permeability of dextran was calculated by previously described methods. A significant difference ($p=0.9748$) between the 5 and 21-day static Transwell™ models was not observed. Furthermore, the results were consistent with previous permeability measurements of a similarly sized dextran across Caco-2 monolayers. In contrast, the apparent permeability across the fluidic device Caco-2 monolayers was 40 and 100 times higher than the static 5-day and 21-day Transwell™ models, respectively ($p<0.0001$). This finding indicates that perfusion likely reduces transport resistance due to a liquid boundary layer above the cells that becomes unstirred, leading to apparent permeability for highly permeable compounds.

During extended culture, typically 3 weeks, Caco-2 on static Transwell™ inserts differentiate toward an intestinal enterocyte phenotype expressing transport proteins and brush border enzymes. Among brush border enzymes, alkaline phosphatase (AP) is a frequently used differentiation marker. Analysis of AP expression revealed a significant 1.7-fold increase ($p=0.0317$) between Caco-2 on static Transwell™ inserts at 5 versus 21 days. However, between Caco-2 cells cultured for=5 days on chip versus static, AP expression significantly ($p=0.0035$) increased 2.2-fold. The increased AP expression was consistent with a previous study that reported 4-fold increased AP activity by human proximal tubular epithelial cells under perfusion. Medium perfusion may expedite cell differentiation via flow induced shear stress or due to a higher nutrient concentration compared to conventional medium replenishment every 48 hours.

Caco-2 mucus production on a fluidic device via alcian blue staining and immunostaining against mucin 2 (Muc2) protein was next assessed. Mucin 2 is the most abundant and the structural protein of the gastrointestinal mucus layer. Alcian blue, a polyvalent dye, is used to identify gastrointestinal mucins. By means of both alcian blue staining and anti-Muc2 immunostaining of the fluidic device, Caco-2 visually appeared to produce more mucus compared to a static Transwell™ model. Previous research reported increased Caco-2 mucus production under medium perfusion, but it was unclear whether mucus production increased due to mechanical stimulus or increased nutrient supply. One study reported increased mucus production by several gastrointestinal cell lines, including Caco-2, in response to mechanical stimulation via fluid flow.

Figure 10A:
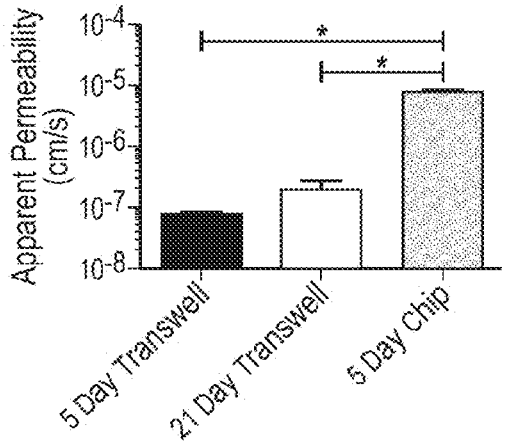
Figure 10B:
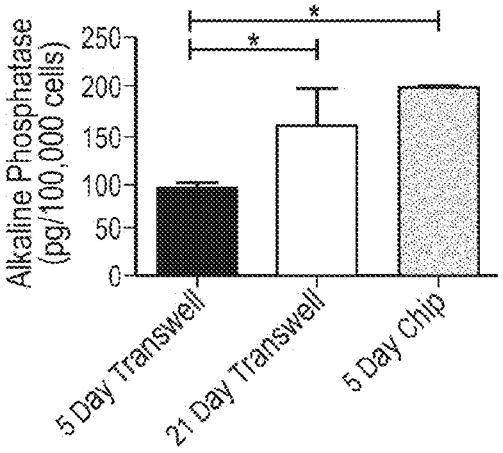
Figure 10C:
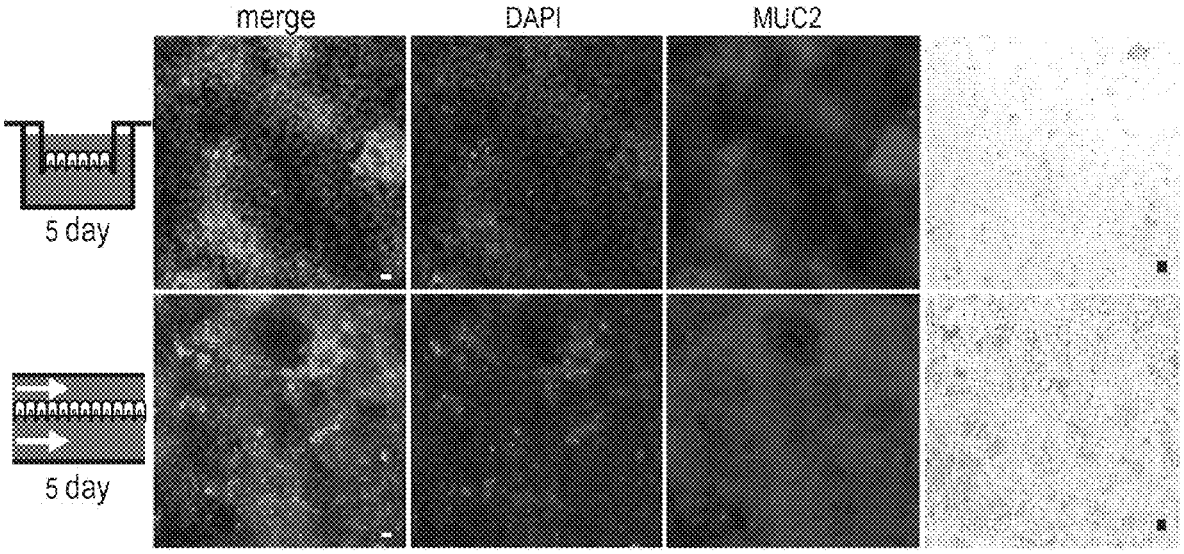

FIGS. 10A-10C are plots and images that illustrate a characterization of epithelial barrier function and Caco-2 monolayer differentiation. FIG. 10A is a plot that illustrates the apparent paracellular permeability quantified by tracking a 4.4 kDa fluorescent dextran through Caco-2 monolayers cultured on Transwell™ inserts for 5 or 21 days and Caco-2 monolayers cultured on the fluidic device for 5 days. Data are presented as mean±SEM from 3 independent experiments each utilizing 3 static inserts and 3 fluidic devices (*$p<0.05$ by ANOVA followed by Tukey's HSD test). FIG. 10B is a plot that illustrates alkaline phosphatase expression of Caco-2 cells cultured on Transwell™ inserts for 5 or 21 days compared to Caco-2 cells cultured on the fluidic device for 5 days. Data are presented as mean±SEM from 3 independent experiments each utilizing 3 static inserts and 3 chips (*$p<0.05$ by ANOVA followed by Tukey's HSD test). FIG. 10C includes images that illustrate qualification of mucus production by Caco-2 monolayers on Transwell™ and on fluidic device. Cells are visualized by DAPI nuclei (blue) staining and mucus protein is visualized by anti-MUC2 staining (red) of Caco-2 cells grown on static Transwell inserts for 5 days (top) and on laser cut and assembled fluidic devices for 5 days (bottom). Right-most panels are independent of immunostained panels and depict Caco-2 monolayers stained with Alcian Blue. Scale bars denote 20 μm.

Exemplification 9: Cut and Assembled Organs-On-Chips Support Primary Human Intestinal Epithelium While Caco-2 cells on permeable supports are frequently used to model enterocytes for transport studies across the small intestinal epithelium, Caco-2 are still limited due to their colorectal adenocarcinoma origin. Caco-2 cells contain unknown genetic mutations, fail to recapitulate the gut's heterogeneous cell population (stem cells, transit-amplifying cells, Paneth cells, goblet cells, enteroendocrine cells, enterocytes), and may not accurately represent any one cell type. Therefore, a more physiologically relevant intestine model was sought to be established by utilizing human primary intestinal epithelial cells expanded as organoids derived from intestinal biopsies. Organoids were dissociated primarily to single cells (82%), with 71% viability. Then, cells were plated on either Transwell™ inserts or on cut and assembled fluidic devices for 5 or 7 days. Static monolayers were maintained under organoid expansion medium (EM) for 2 days followed by differentiation medium (DM) for 5 days while fluidic device monolayers were maintained under EM for 3 days followed by DM for 2 days. Monolayers were then fixed and stained for F-actin, tight junction protein ZO-1, and cell nuclei. Primary cells formed confluent monolayers with comparable morphology and tight junctions under both culture conditions, demonstrating suitability for future epithelial barrier studies. Barrier integrity (comparing primary monolayers on fluidic device versus on static inserts) was then quantified by measuring the apical to basal paracellular transport of fluorescent Lucifer Yellow (450 Da). A significant increase (p-value=0.0029) in the apparent permeability between the 5-day static and fluidic device models was observed, consistent with observations for Caco-2 cells. These results indicate that cut and assembled organ fluidic devices support primary intestinal cells to form confluent monolayers expressing tight junctions and low permeability under a continuous perfusion microenvironment.

Figure 11A:
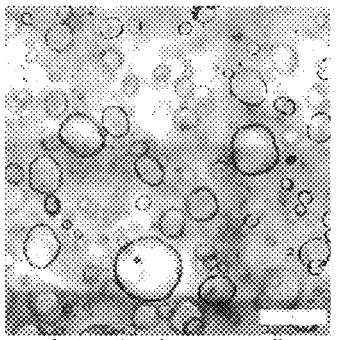
Figure 11B:
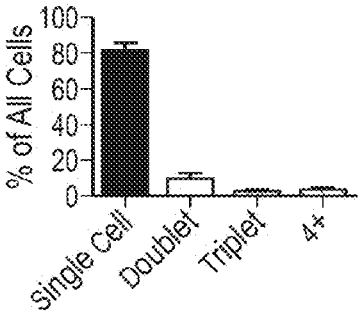
Figure 11C:
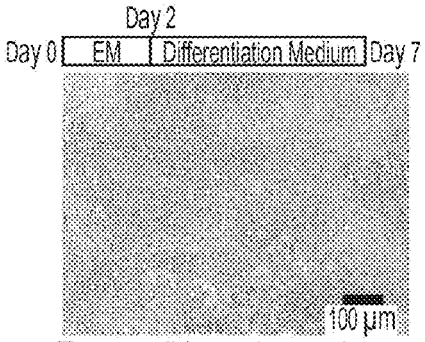
Figure 11D:
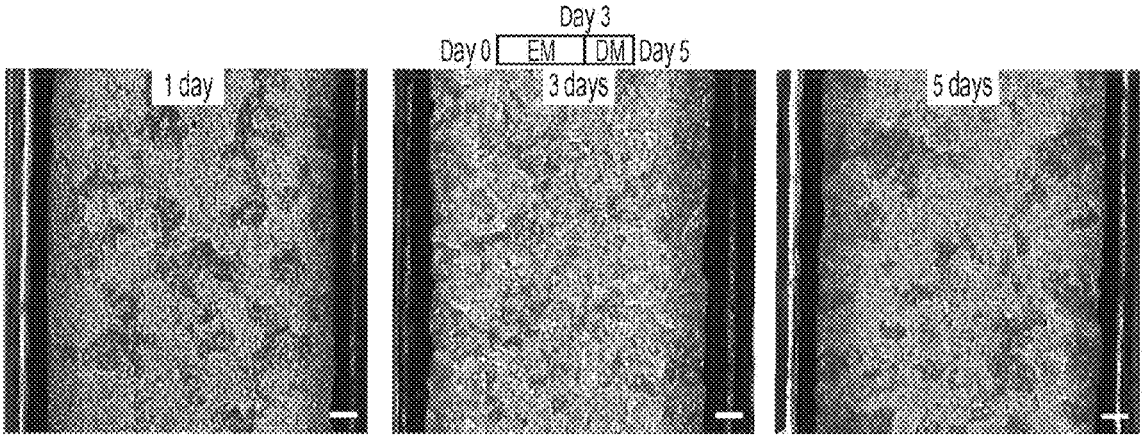

FIGS. 11A-11D include images and a plot that show formation of primary human intestinal monolayers from biopsy-derived organoid cultures. FIG. 11A is an image of organoid expansion in 3D Matrigel. Scale bar denotes 500 μm. FIG. 11B is a plot that shows the percentage of cells/clumps occurring as single cells, doublets, triplets, or clumps of 4 or more cells after organoid dissociation from three independent experiments. FIG. 11C is an image of Transwell™ based monolayers that were maintained for 7 days; the phase contrast microscopy image shows Transwell™ primary human epithelial monolayers at 7 days (note that EM was switched to DM at Day 2). FIG. 11D is a sequence of phase contrast images of primary human epithelial monolayers in the bi-layer fluidic device at 1, 3, and 5 days post seeding (note that EM was switched to DM at Day 3). Scale bar denotes 100 μm.

FIGS. 12A-12C are images and data that show primary human intestinal epithelium on fluidic device within cavity defined by member. FIG. 12A are images of cells visualized by immunostaining against ZO-1 tight junctions (green), DAPI nuclei (cyan), and F-actin cytoskeleton (red) of primary intestinal cells grown on laser cut and assembled chips for 5 days (bottom) and static inserts for 7 days (top). Scale bar denotes 20 μm. FIG. 12B-1 is an image produced by phase contrast microscopy that shows primary human epithelium at 5 days across the entire length of the chip and, in FIG. 12B-2, a higher magnification of the area denoted by the white rectangle (bottom, scale bar denotes 500 μm). FIG. 12C is a plot that shows the apparent paracellular permeability quantified by tracking Lucifer Yellow through primary epithelial monolayers cultured on Transwell inserts or on bi-layer chips for 5 days. Data are presented as mean±SEM from 3 independent experiments each utilizing 3 static inserts and 3 fluidic devices generated from organoids isolated from one donor (*$p=0.0029$ by Student's t-test).

Exemplification 10: Integration of Primary Human Intestinal Monolayers and Intact Organoids in Tri-Layered Organ Fluidic Devices In an embodiment of the tri-layer organ fluidic device described herein, tissue growth may be promoted by direct contact between the monolayer and Matrigel through the 30 μm pores as the bi-layer chip was only collagen I coated. Confocal fluorescence microscopy revealed organoids in close proximity to the basal regions of the monolayer and 3D tissue structures. It is possible, though unproven, that intact organoids adjacent to the epithelium communicate with the differentiated epithelial monolayer via paracrine signaling to drive morphological changes. For example, intestinal hedgehog signaling in the intervillus pockets of the developing epithelium is involved in crypt-villus axis formation during development and the adult small intestine retains Indian Hedgehog (Ihh) ligands in the differentiated villi. Thus, the tri-layer, monolayer and organoid integrated gut fluidic device may exhibit more native functionality relative to independently cultured monolayers or organoids. As paracrine Hedgehog signaling between epithelial and mesenchymal cells promotes stromal niche formation which affects epithelial proliferation and differentiation, the embodiment of the tri-layer organ fluidic device described herein is a particularly powerful tool for integrating the small intestine's mesenchymal components (fibroblasts, endothelial cells, enteric neurons, and glia) and studying paracrine or cell-to-cell contact dependent (enteroendocrine cell-enteric glia) signaling.

Figure 13:
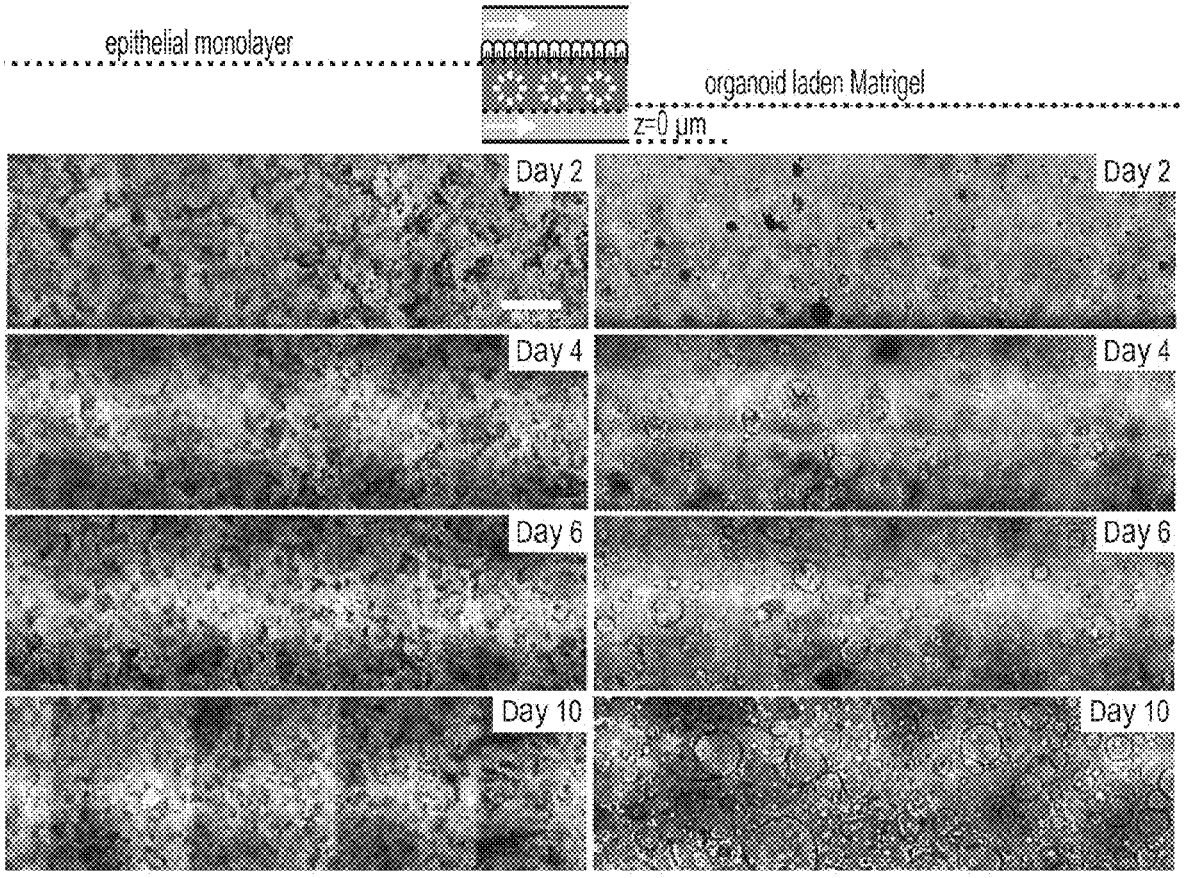

FIG. 13 includes an example embodiment of phase contrast images of primary human epithelial monolayers and organoids in the tri-layer chip at 2, 4, 6, and 10 days post seeding (note that apical Expansion Media was switched to Differentiation Media at Day 6). Scale bar denotes 500 μm.

Figure 14A:
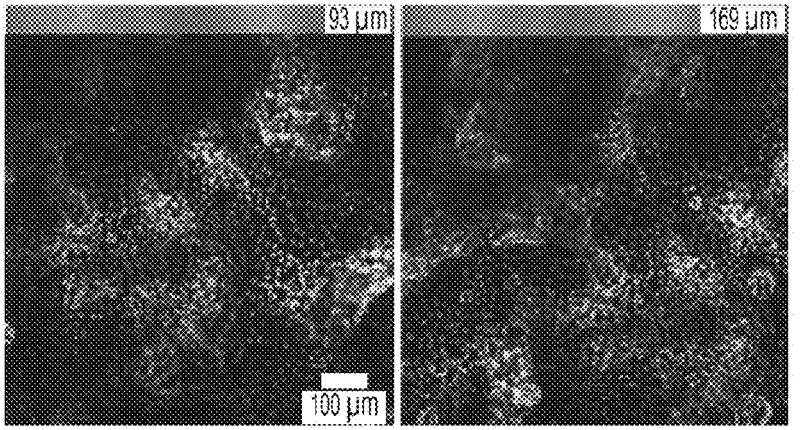
Figure 14B:
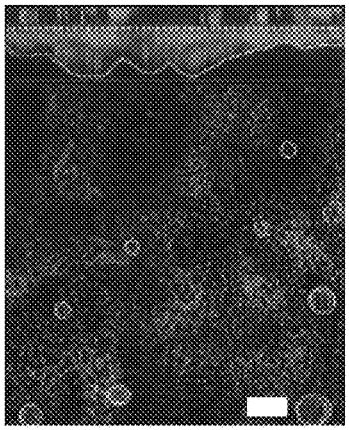
Figure 14C:
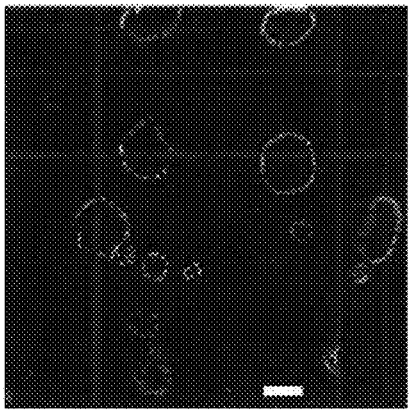
Figure 14D:
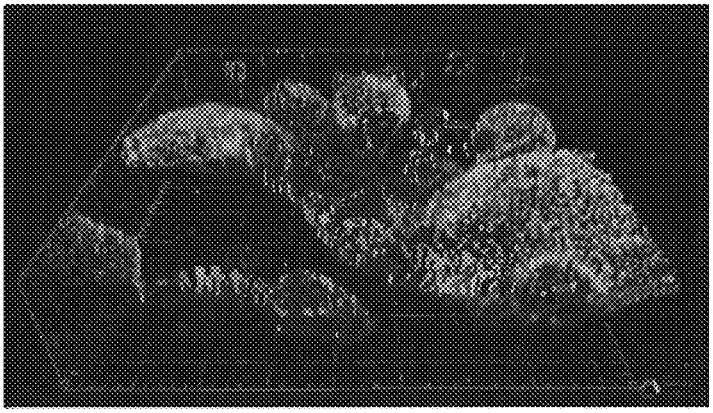

FIGS. 14A-D are images of a structural analysis of a dual membrane tri-layered organ fluidic device integrating primary human intestinal monolayers and intact organoids. FIG. 14A includes images and plot of Z-depth color coded maximum intensity projections of the monolayer cultured on fluidic device for 10 days and stained with DAPI when viewed from above by confocal microscopy. The color bars above the image specify the range of z-depths in μm. FIG. 14B is an image of a representative maximum intensity z-projection and the corresponding orthogonal view of the monolayer cultured for 10 days and stained with DAPI when viewed from above by confocal microscopy. The dashed white lines indicate the upper and lower surfaces of the primary monolayer, while the dashed white circles indicate underlying intact organoids in close proximity to the monolayer. FIG. 14C is an image that provides representative orthogonal views of intact organoids cultured on fluidic device for 10 days, stained with DAPI, and imaged by confocal microscopy. FIG. 14D is a representative 3D reconstruction of confocal immunofluorescence micrographs of intact organoids cultured on fluidic device for 10 days and stained for DAPI. Scale bars denote 100 μm.

While example embodiments have been particularly shown and described, it will be understood by those skilled in the art that various changes in form and details may be made therein without departing from the scope of the embodiments encompassed by the appended claims.

What is claimed is:

1. A fluidic device, the device comprising;

at least three layers, each layer comprising:

a) a member with first and second sides, the first and second sides being opposing sides, and defining a cavity, the opposing sides including an adhesive compound thereon, b) a first substrate adhesively coupled to the first side of the member, c) a second substrate adhesively coupled to the second side of the member; and a porous membrane disposed between a given two of the at least three layers, at least one of the first and second substrates of each of the given two layers defining an inlet port and an outlet port, at least one of the first and second substrates of each of the given two layers defining a flow path in fluid connection with the inlet and outlet ports, the flow path disposed at the cavity of the member, each inlet port enabling fluid external from the first and second substrates to flow into the cavity, each outlet port enabling fluid to flow out of the cavity, the adhesive compound coupling the first and second substrates to the member, the porous membrane and the flow path of one of the given two layers defining an apical channel, the porous membrane and the flow path of the other of the two layers defining a basal channel, and the other of the at least three layers being a phase guide layer comprising a phase guide configured to define a fluid subcompartment in the cavity of one of the given two layers.

2. The device of claim 1, wherein the cavity defines at least a portion of the flow path.

3. The device of claim 1, wherein the member further defines the cavity from the first side through the second side.

4. The device of claim 1, wherein at least one of the first and second substrates of at least one of the given two layers further defines a plenum, and wherein the member and the first and second substrates are oriented with the plenum in fluidic communication with the cavity.

5. The device of claim 1, wherein the subcompartment is configured to hold a biological sample.

6. The device of claim 5, wherein the flow path of the one layer is in fluidic communication with the subcompartment defined by the phase guide, wherein the subcompartment is further configured to provide for an interaction between the biological sample and a medium in the flow path.

7. The device of claim 1, wherein theother layer, comprising the phase guide, further comprises at least one port configured to enable a medium to flow therethrough for deposit into the at least one subcompartment, the medium being a solid, liquid, or gas.

8. The device of claim 1, wherein the device further comprises a sensor in fluidic communication with the cavity or the flow path of at least one of the at least three layers.

9. The device of claim 1, further comprising a sensor applied to the first or second substrate of at least one of the at least three layers, wherein the sensor is in fluidic communication with the cavity.

10. The device of claim 1, further comprising a specimen port configured to introduce a sample into a central cavity defined by at least one of the at least three layers.

11. A fluidic device kit, the kit comprising;

at least three layer sets, each layer set comprising:

a member with a cavity defined therein, the member including an adhesive compound on opposing sides, a first substrate, adherable to a first side of the member, and a second substrate, adherable to a second side of the member; and at least one porous membrane configured to be disposed between a given two of the at least three layer sets, wherein the member and the first and second substrates of each of the given two layer sets are configurable for defining a flow path in fluidic connection with an inlet port and an outlet port, the flow path disposed at the cavity of the member, the flow path of one of the given two layer sets configurable with the at least one porous membrane for defining an apical channel, and the flow path of the other of the given two layer sets configurable with the at least one porous membrane for defining a basal channel, and the other of the at least three layer sets comprising a phase guide configurable to define a fluid subcompartment in the cavity of one of the given two layer sets.

12. The fluidic device of claim 1, wherein the porous membrane comprises at least two porous membranes, one of the at least two porous membranes defining the apical channel and the other of the at least two porous membranes defining the basal channel.

13. The fluidic device of claim 1, wherein the phase guide comprises a partition disposed between a port and a cavity of the phase guide layer.

14. The fluidic device of claim 13, wherein the partition is configured to project into a cavity defined by the cavity of the phase guide layer and the cavity of the one of the given two layers.

15. The fluidic device of claim 1, wherein the phase guide is defined by the member at least one of the first and second substrates of the phase guide layer.

16. The fluidic device of claim 1, wherein the phase guide is configured to enable formation of a meniscus of a fluid disposed in the cavity.

17. The fluidic device of claim 1, wherein the phase guide layer further comprises at least one inlet port configured to enable a flow of a fluid into the subcompartment.

18. The fluidic device of claim 1, wherein the phase guide layer further comprises a ventilation port configured to ventilate a fluid from the cavity of the one of the two given layers.

* * * * *